US005675347A

United States Patent [19]

Terashima et al.

[11] Patent Number: 5,675,347

[45] Date of Patent: *Oct. 7, 1997

[54] HIGH FREQUENCY WAVE GLASS ANTENNA FOR AN AUTOMOBILE

[75] Inventors: Fumitaka Terashima; Toshihiko Saitou; Kiyoshi Shibata, all of Kawasaki, Japan

[73] Assignee: Asahi Glass Company Ltd., Tokyo, Japan

[ * ] Notice: The term of this patent shall not extend beyond the expiration date of Pat. No. 5,568,156.

[21] Appl. No.: 654,209

[22] Filed: May 28, 1996

Related U.S. Application Data

[63] Continuation of Ser. No. 432,080, May 1, 1995, Pat. No. 5,568,156, which is a continuation of Ser. No. 133,212, Oct. 7, 1993, abandoned.

[30] Foreign Application Priority Data

Oct. 9, 1992 [JP] Japan ..... 4-298018

[51] Int. Cl.[6] ..... H01Q 1/32

[52] U.S. Cl. ..... 343/713; 343/741; 343/846

[58] Field of Search ..... 343/713, 742, 343/752, 867, 848, 846, 741

[56] References Cited

U.S. PATENT DOCUMENTS

| | | | |
|---|---|---|---|
| 3,866,232 | 2/1975 | Weigt | 343/713 |
| 4,992,800 | 2/1991 | Parfitt | 343/713 |
| 4,992,801 | 2/1991 | Saito et al. | 343/713 |
| 5,220,336 | 6/1993 | Hirotsu et al. | 343/713 |
| 5,239,669 | 8/1993 | Mason et al. | 343/713 X |
| 5,402,134 | 3/1995 | Miller et al. | 343/713 X |
| 5,422,650 | 6/1995 | Hill | 343/713 |
| 5,521,606 | 5/1996 | Lijima et al. | 343/713 |
| 5,568,156 | 10/1996 | Terashima et al. | 343/713 |

FOREIGN PATENT DOCUMENTS

| | | | |
|---|---|---|---|
| 2328167 | 12/1974 | Germany | 343/713 |
| 3834075 | 4/1989 | Germany | 343/713 |

*Primary Examiner*—Hoanganh T. Le
*Assistant Examiner*—Tan Ho
*Attorney, Agent, or Firm*—Oblon, Spivak, McClelland, Maier & Neustadt, P.C.

[57] ABSTRACT

A high frequency wave glass antenna for automobile in which a line shape or a strip shape antenna conductor is provided on a glass plate of a window of an automobile in an approximately circular, an approximately elliptic or an approximately polygonal form having an opening portion, a first end of two ends on both sides in the vicinity of the opening portion of the antenna conductor is connected to an electricity feeding portion and a second end thereof is connected to a grounding conductor, and which provides the electricity feeding portion and the grounding conductor that are proximate to each other, or the grounding conductor having a predetermined area.

31 Claims, 17 Drawing Sheets

HIGH FREQUENCY WAVE GLASS ANTENNA FOR AN AUTOMOBILE

This is a Continuation, of application Ser. No. 08/432,080 filed on May 1, 1995 now U.S. Pat. No. 5,568,756, which is a Continuation of application Ser. No. 08/133,212 filed on Oct. 7, 1993, abandoned.

BACKGROUND OF THE INVENTION

1. Field of the Invention

The present invention relates to a high frequency wave glass antenna for an automobile which is suitable for receiving a radiowave having a wavelength of 300 MHz to 3 GHz (UHF band) and is excellent in the receiving sensitivity.

2. Discussion of Background

There is the Global Positioning System (GPS) using artificial satellites as a means for detecting the position of an automobile.

Concerning an antenna for the GPS satellites, a GPS antenna of a micro strip antenna has already been on sale which is formed with conductor layers on the surface and on the rear face of a dielectric substrate as an antenna conductor and a grounding conductor, and a receiving signal excited between the antenna conductor and the grounding conductor is amplified a preamplifier circuit.

This conventional GPS antenna has been employed by on a roof or on a trunk of an automobile by a magnet attached to a case, or by a fixture, or by fixing it in the interior side of a glass windown of an automobile in the vicinity of an opening portion of the automobile such as a window by a method of screwing or the like. However, the conventional GPS antenna is too large, and is unattractive when installed on the roof or on the trunk. Further, there is a danger of robbery. An aging deterioration is caused since it is installed outside of an automobile.

Further, even when the antenna is installed on the interior of a glass window of an automobile in the vicinity of a window of an automobile, a wide space is necessary for attaching it. Therefore, the viewing angle is narrowed when the window of an automobile through which a radiowave is transmitted into the car room, is viewed from the attaching position and, the receiving range is also narrowed.

SUMMARY OF THE INVENTION

It is an object of the present invention to solve the above drawbacks of the conventional technology and to provide a high frequency wave glass antenna for an automobile which is small-sized antenna whereby the danger of robbery is minimized, the aging deterioration is reduced and the exterior beauty is not spoiled since it is installed in the interior of the car. At the same time, a wide receiving range is provided and the receiving sensitivity and the like are excellent even when it is installed in the car interior.

According to an aspect of the present invention, there is provided a high frequency wave glass antenna for an automobile in which a line shape or a strip shape antenna conductor is provided on a glass plate of a window of an automobile in an approximately circular, approximately elliptic or approximately polygonal form having an opening portion, one end of two ends on both sides of the antenna conductor in the vicinity of the opening portion is connected to an electricity feeding portion and other end thereof is connected to a grounding conductor, wherein an area of the grounding conductor is not smaller than 2.5 $cm^2$.

According to another aspect of the present invention, there is provided a high frequency wave glass antenna for an automobile in which a line shape or a strip shape antenna conductor is provided on a glass plate of a window of an automobile in an approximately circular, approximately elliptic or approximately polygonal form having an opening portion, one end of two ends on both sides of the antenna conductor in the vicinity of the opening portion is connected to an electricity feeding portion and other end thereof is connected to a grounding conductor, wherein the electricity feeding portion and the antenna conductor in the vicinity of the electricity feeding portion are proximate to the grounding conductor in a range of a capacitive coupling.

According to another aspect of the present invention, there is provided a high frequency wave glass antenna for an automobile in which a line shape or a strip shape antenna conductor is provided on a glass plate of a window of an automobile in an approximately circular, approximately elliptic or approximately polygonal form having an opening portion, a first end of two ends on both sides of the antenna conductor in the vicinity of the opening portion is connected to an electricity feeding portion and a second end thereof is connected to a grounding conductor, wherein the grounding conductor is extended toward the electricity feeding portion such that a distance from the first end of the antenna conductor on a first side of the grounding conductor to a third end of the grounding conductor on a second side of the electricity feeding portion is not smaller than 50% of an inner transverse width of the antenna conductor.

According to another aspect of the present invention, there is provided the high frequency wave glass antenna for an automobile according to the above aspect in which a line shape or a strip shape antenna conductor is provided on a glass plate of a window of an automobile in an approximately circular, approximately elliptic or approximately polygonal form having an opening portion, one end of two ends on both sides of the antenna conductor in the vicinity of the opening portion is connected to an electricity feeding portion and other end thereof is connected to a grounding conductor, wherein a total or a portion of the electricity feeding portion is provided in a cut-off portion formed in a region of the grounding conductor.

According to another aspect of the present invention, there is provided the high frequency wave glass antenna for an automobile according to the above aspect in which a line shape or a strip shape antenna conductor is provided on a glass plate of a window of an automobile in an approximately circular, approximately elliptic or approximately polygonal form having an opening portion, one end of two ends on both sides of the antenna conductor in the vicinity of the opening portion is connected to an electricity feeding portion and other end thereof is connected to a grounding conductor, wherein an area of the grounding conductor is not smaller than 2.5 $cm^2$ and the antenna conductor is provided such that at least a portion of the grounding conductor is surrounded by the antenna conductor.

BRIEF DESCRIPTION OF TEE DRAWINGS

FIG. 8 is a front view showing a variation example of FIG. 1 with respect to a branch line 10 and the like;

FIG. 9 is a front view showing another variation example of FIG. 1 with respect to a branch line 10 and the like;

FIG. 10 is a front view showing another variation example of FIG. 1 with respect to a branch line 10 and the like;

FIG. 11 is a front view showing another variation example of FIG. 1 with respect to a branch line 10 and the like;

Figure 5:
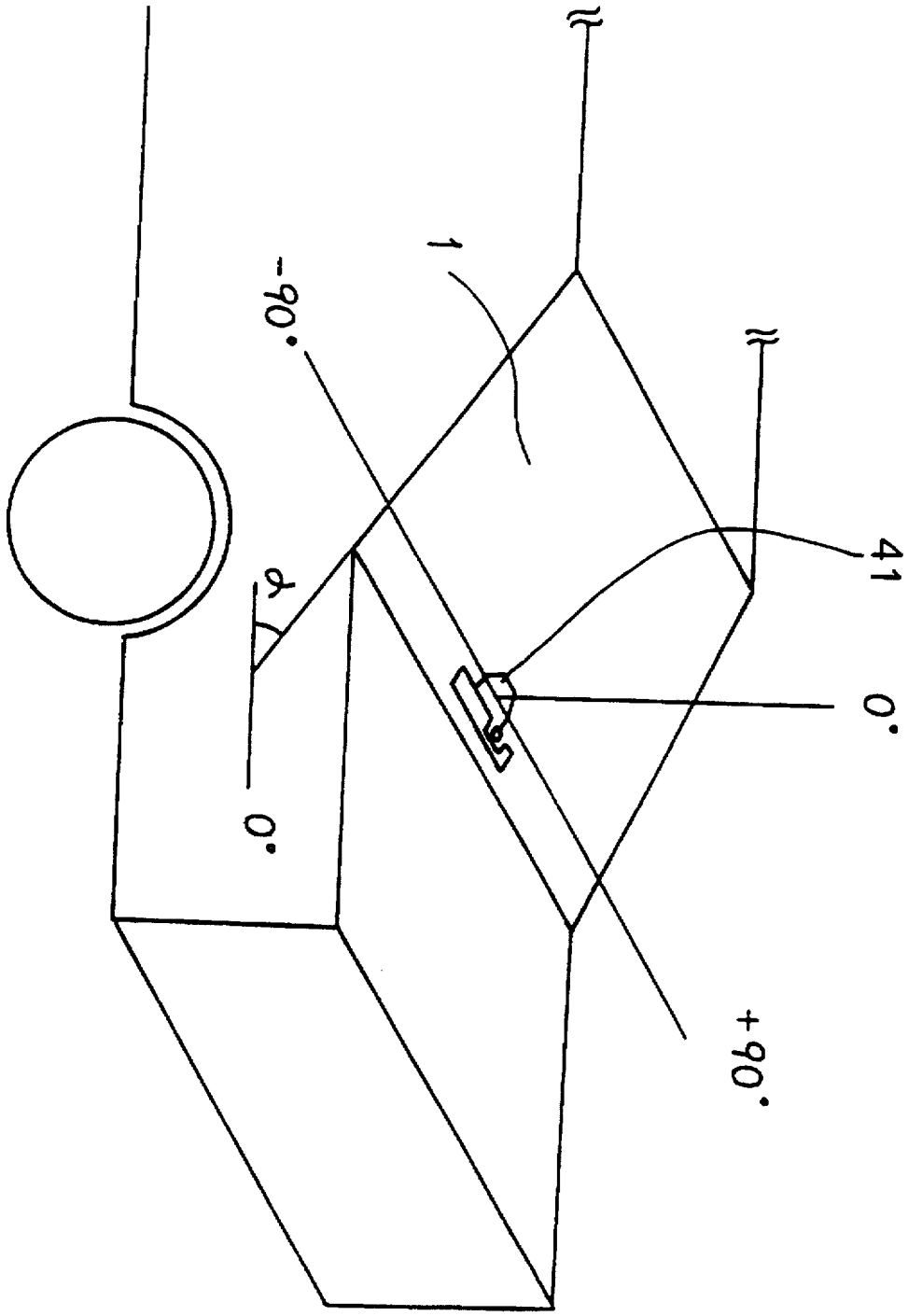
FIG. 5 is a perspective diagram wherein a high frequency wave glass antenna of this invention is provided on a glass plate of a rear window of an automobile.
Figure 12:
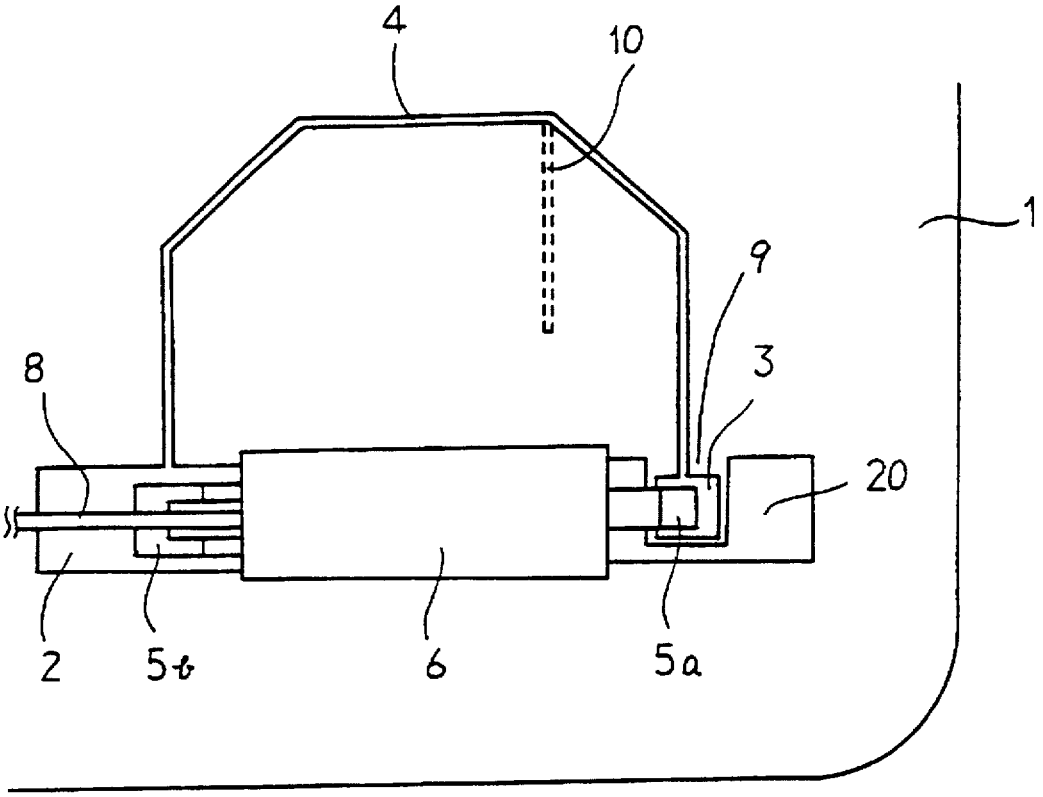
FIG. 12 is a front view showing embodiments 3 and 4.
Figure 13:
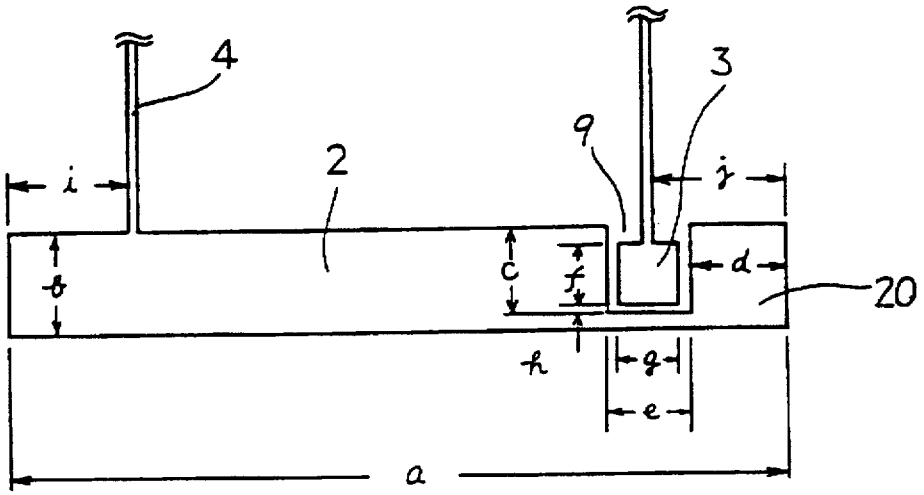
Figure 14:
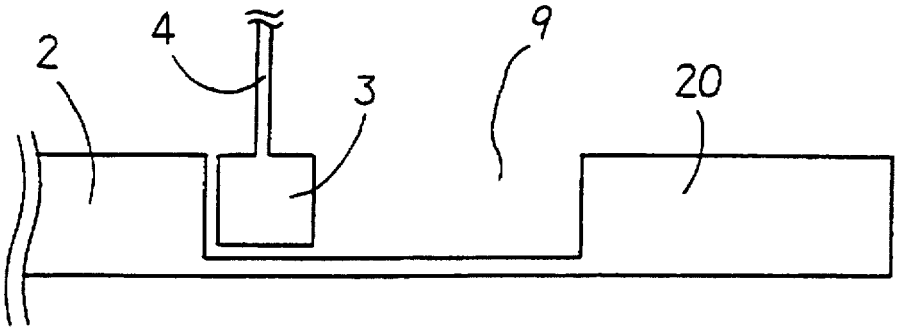
Figure 15:
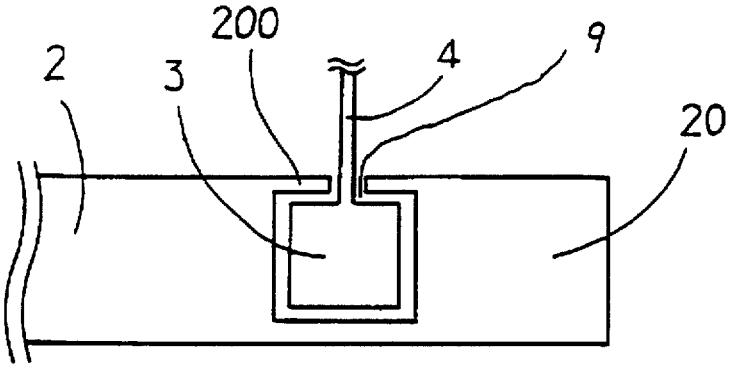
Figure 16:
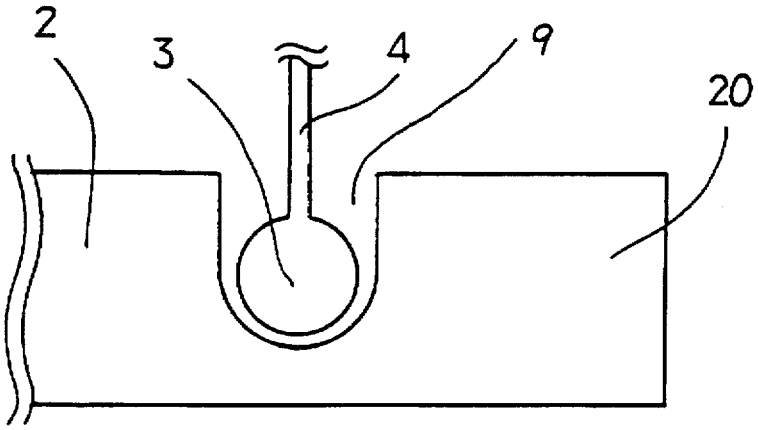
Figure 17:
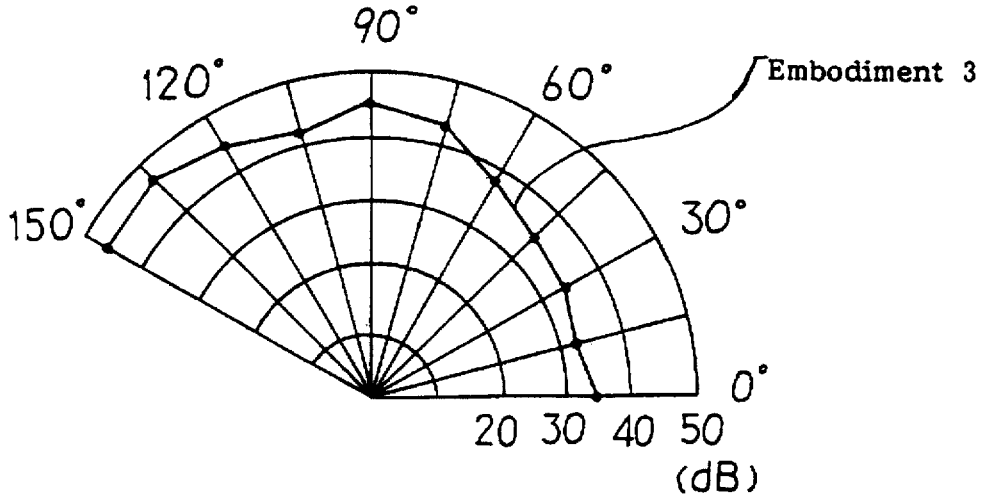
Figure 18:
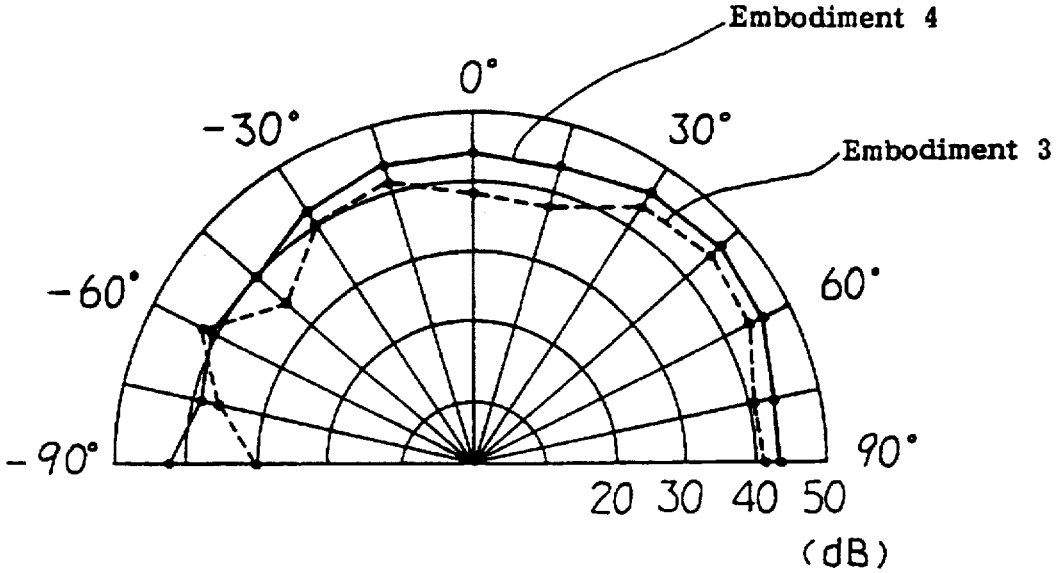
Figure 19:
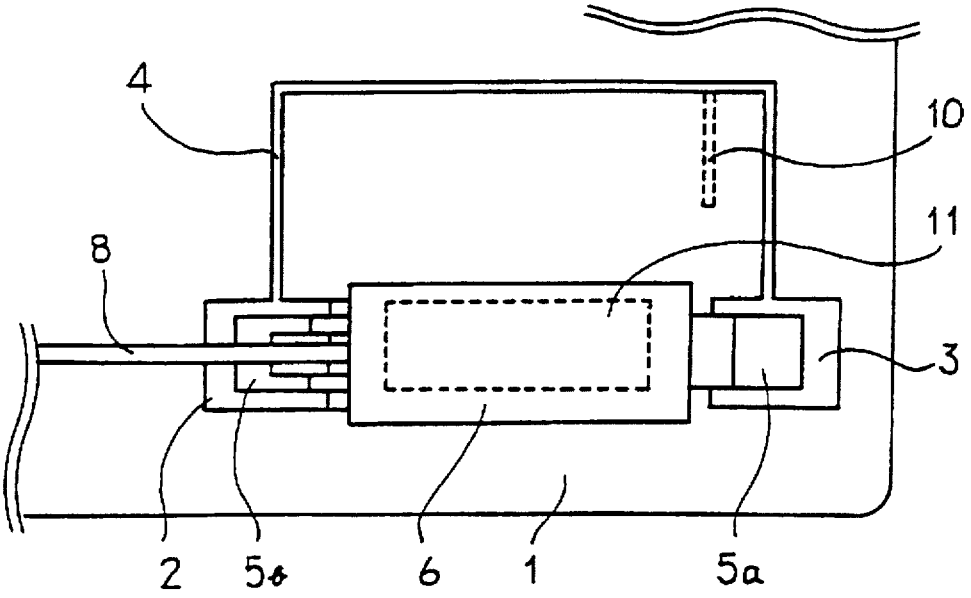
Figure 20:
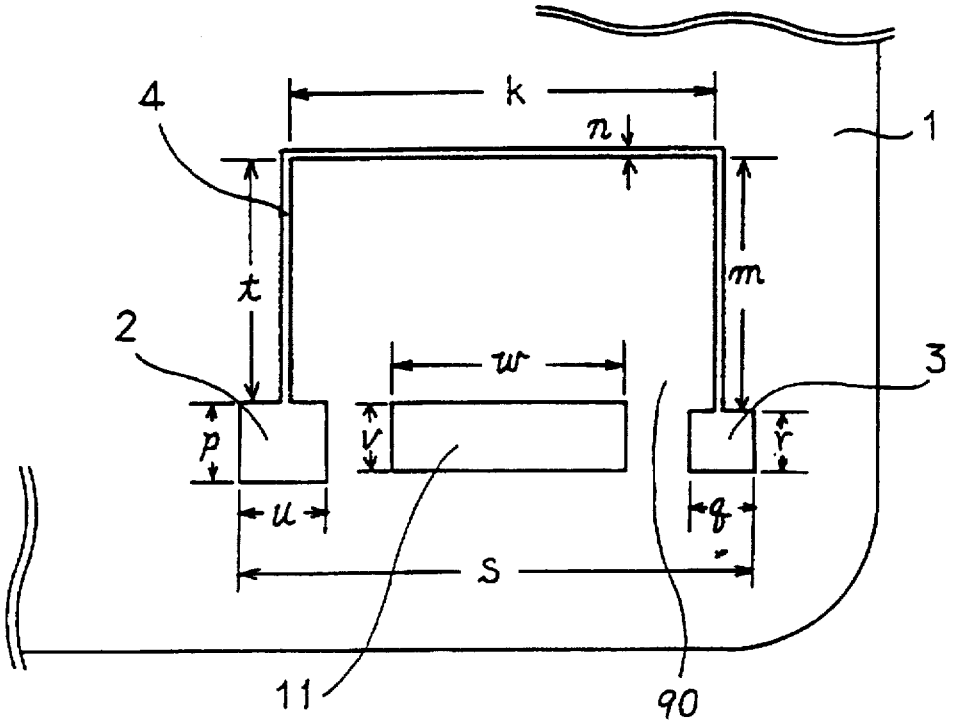
Figure 21:
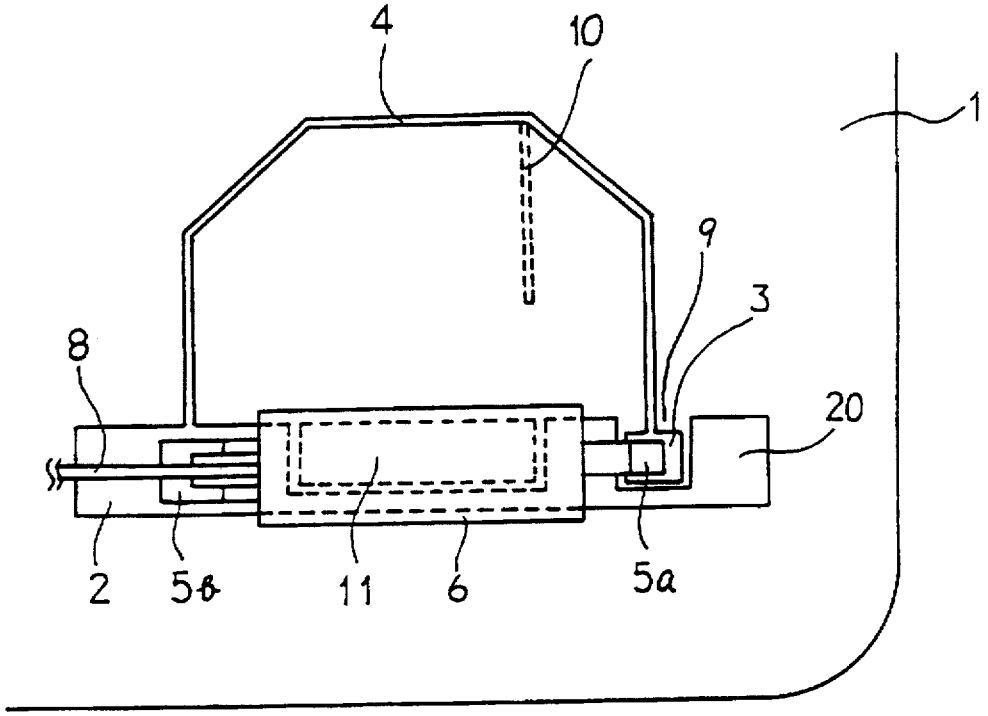
Figure 22:
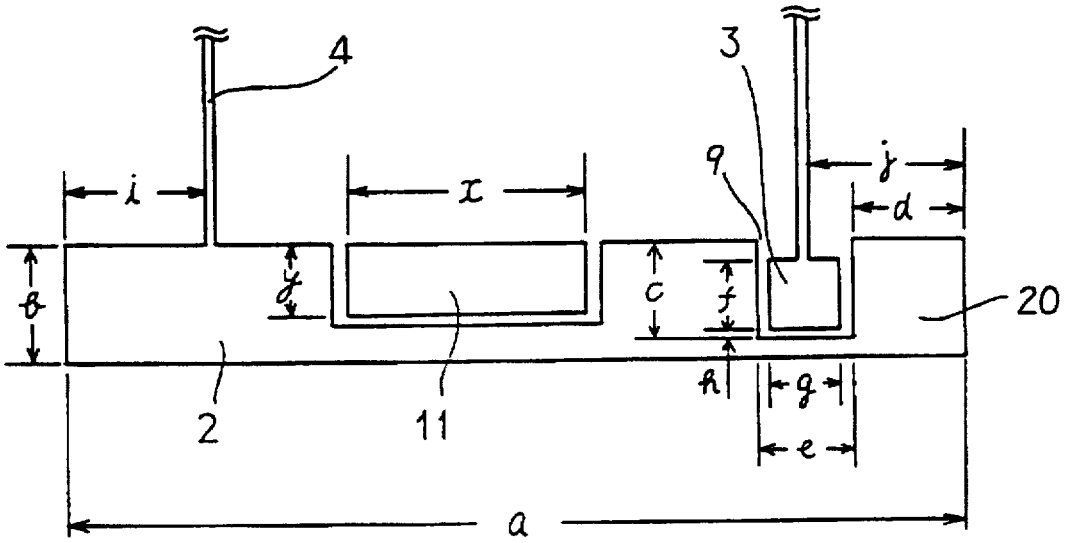
Figure 23:
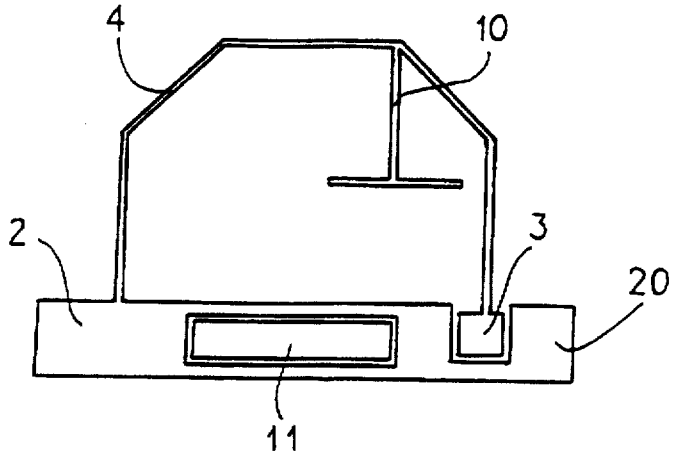
Figure 24:
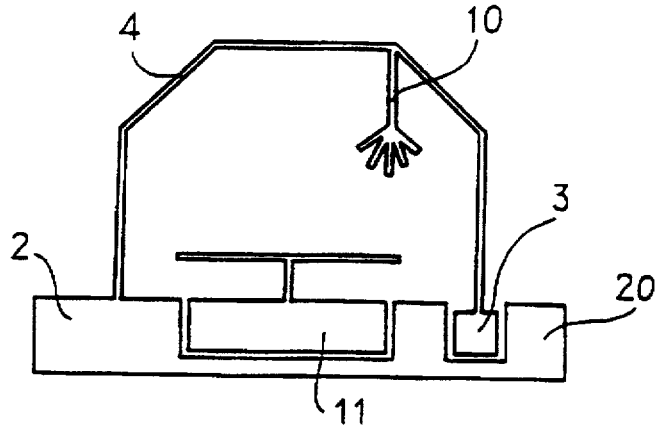
Figure 25:
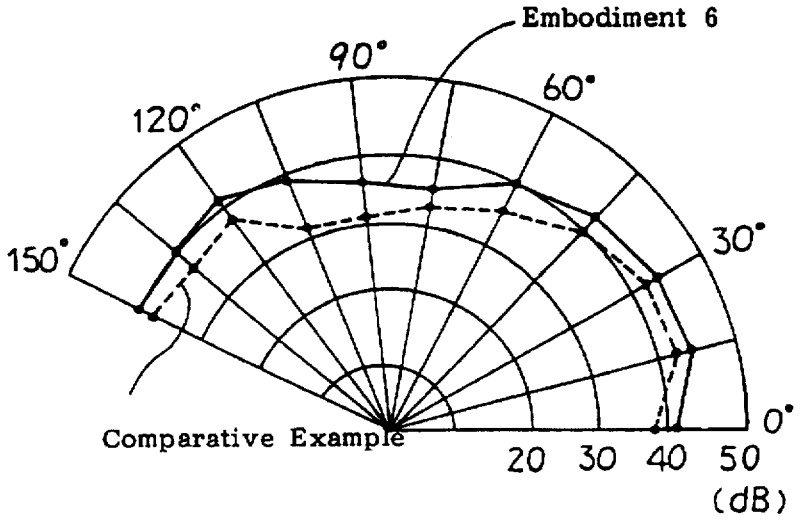
Figure 26:
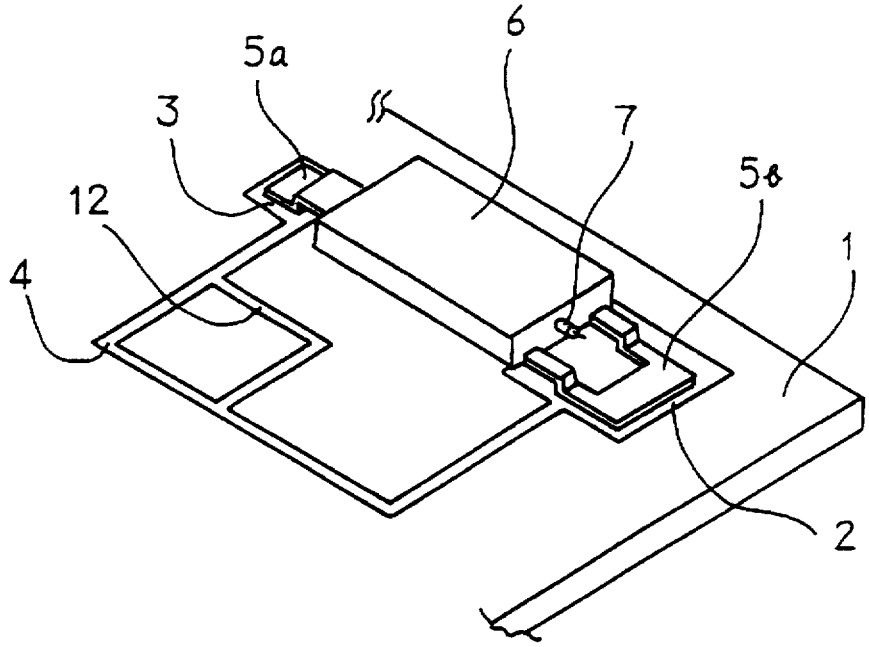
Figure 27:
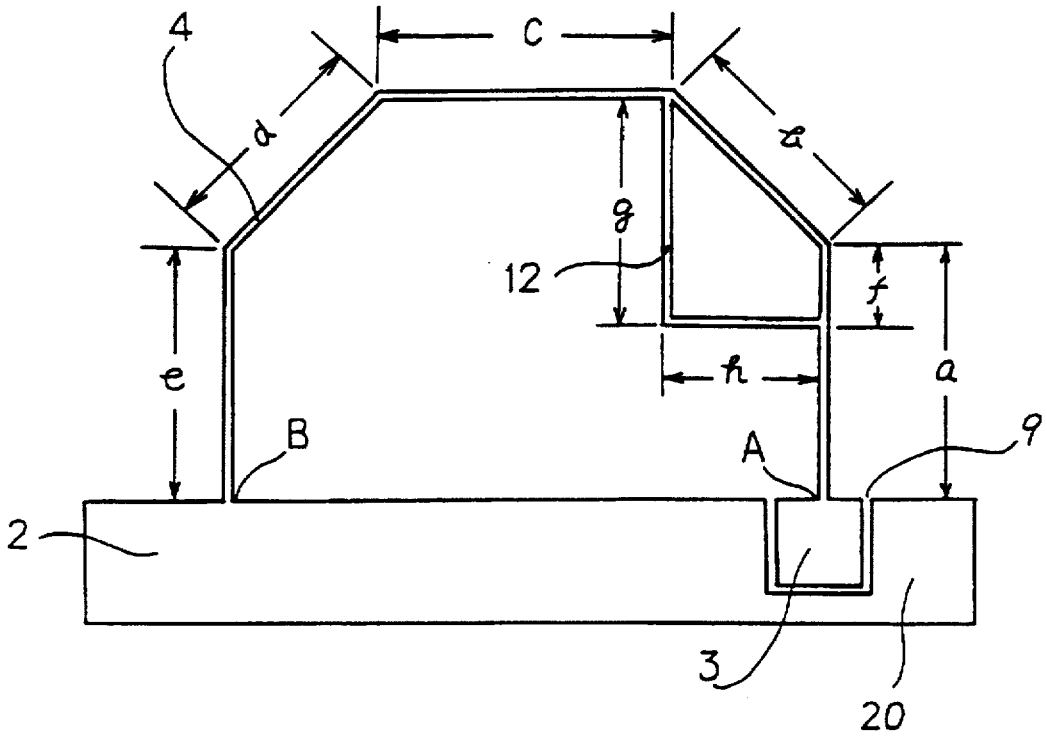
Figure 28:
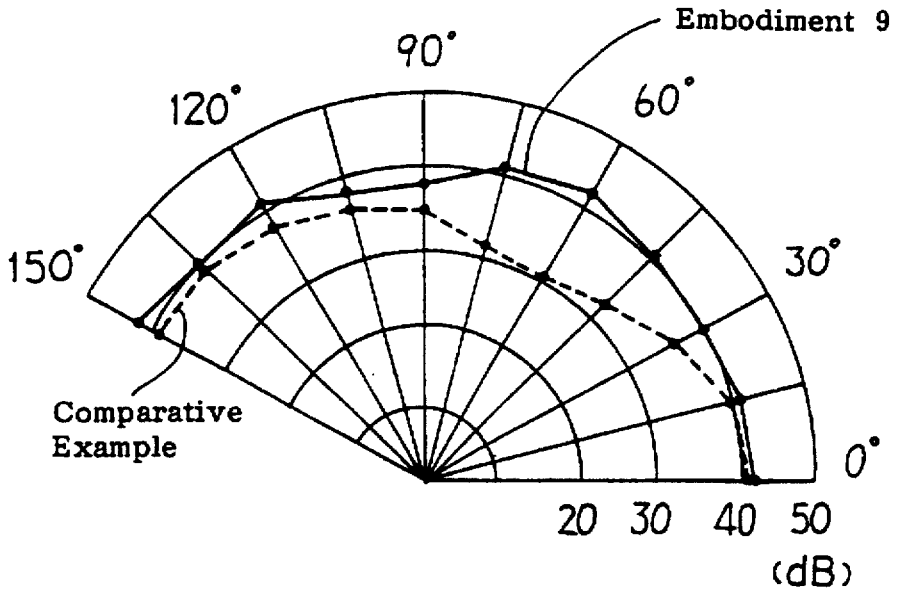
Figure 29:
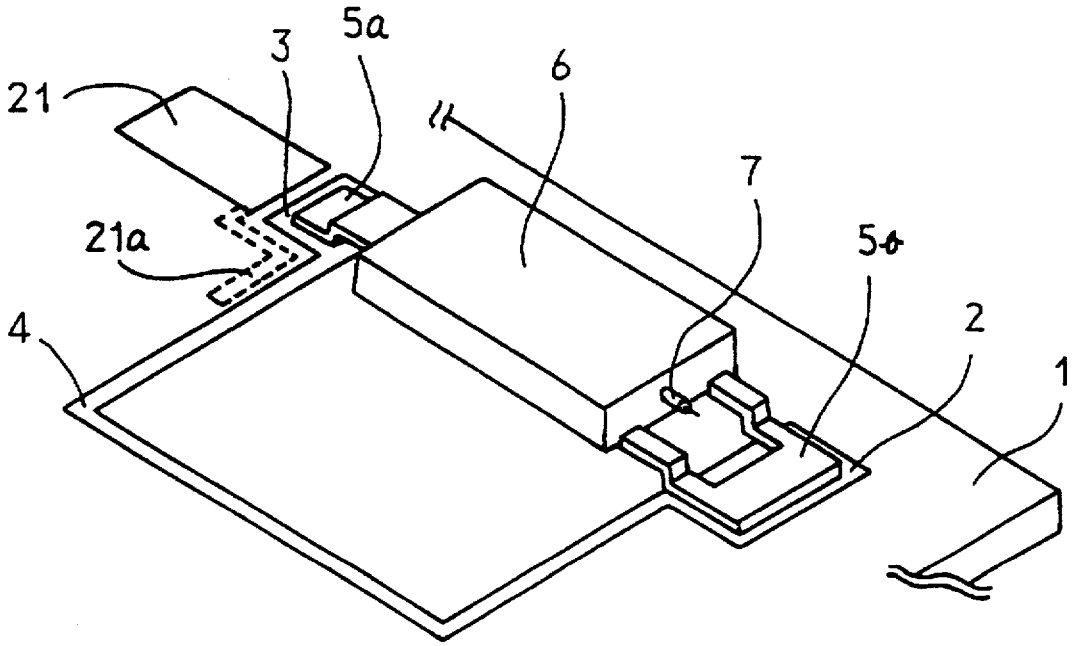

FIG. 13 is a front view of a grounding conductor 2 which is employed in the embodiments 3 and 4;

FIG. 14 is a front view of a variation example of the cut-off portion 9 shown in FIGS. 12 and 13;

FIG. 15 is a front view of a variation example of the cut-off portion 9 shown in FIGS. 12 and 13;

FIG. 16 is a front view of a variation example of the cut-off portion 9 shown in FIG. 12 and 13;

FIG. 17 is a characteristic diagram of a receiving gain of the embodiment 3;

FIG. 18 shows characteristic diagrams of receiving gains of the embodiments 3 and 4 in angular directions of 90°, 0° (vertical) and −90° in FIG. 5;

FIG. 19 is a front view showing embodiment 5;

FIG. 20 is a front diagram of a grounding conductor 2, an insular conductor 11 and the like of the embodiment FIG. 21 is a front view showing embodiments 6 and 7;

FIG. 22 is a front diagram of a grounding conductor 2 and the like of the embodiment 6;

FIG. 23 is a front view showing a variation example of an insular conductor 11 shown in FIG. 22;

FIG. 24 is a front view showing another variation example of the insular conductor 11 shown in FIG. 22;

FIG. 25 shows characteristic diagrams of receiving gains of the Example 6 and a comparative Example;

FIG. 26 is a front view showing embodiment 8;

FIG. 27 is a front view showing Example 9;

FIG. 28 shows characteristic diagrams of receiving gains of the embodiment 9 and a comparative Example;

FIG. 29 is a perspective diagram showing Example

Figure 30:
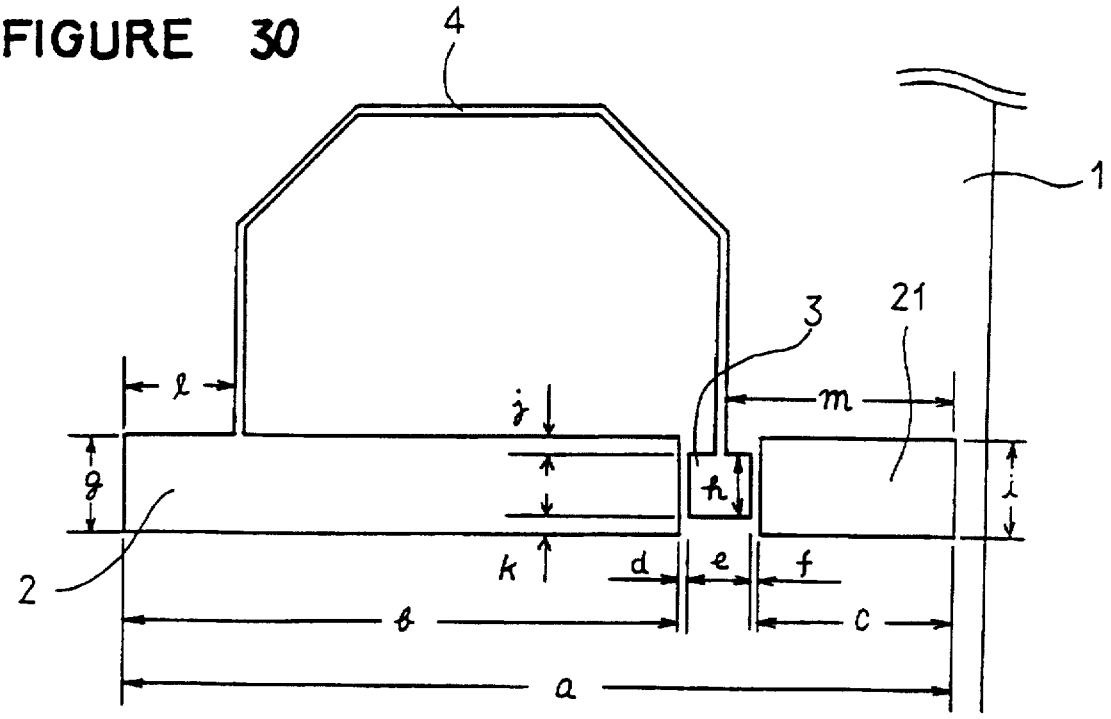
Figure 31:
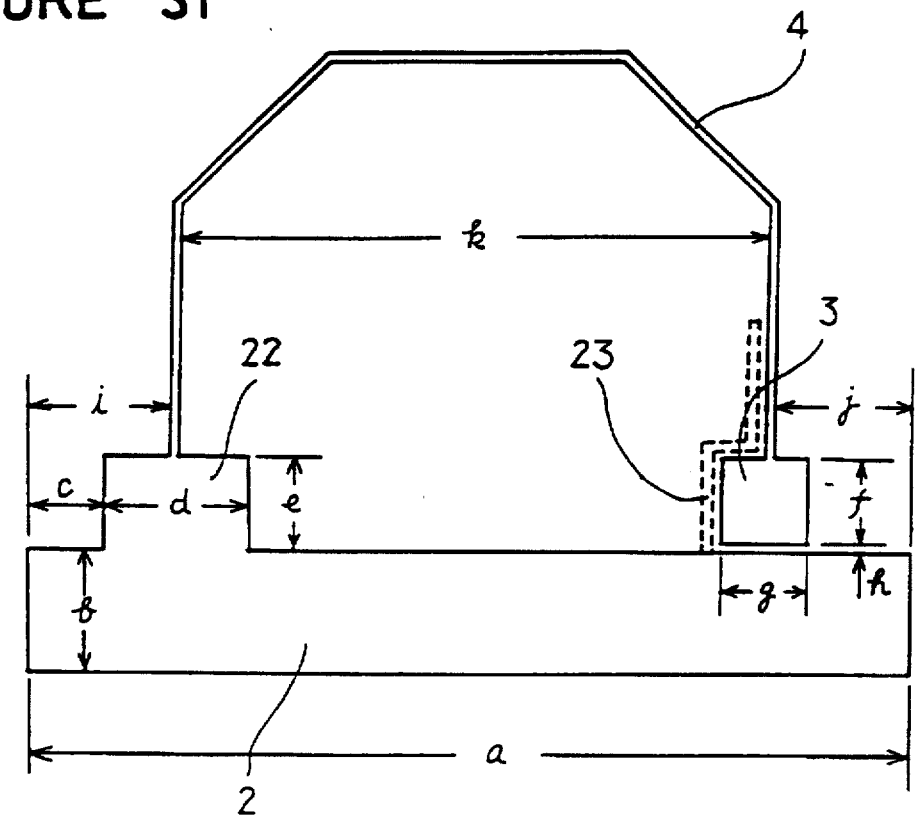
Figure 32:
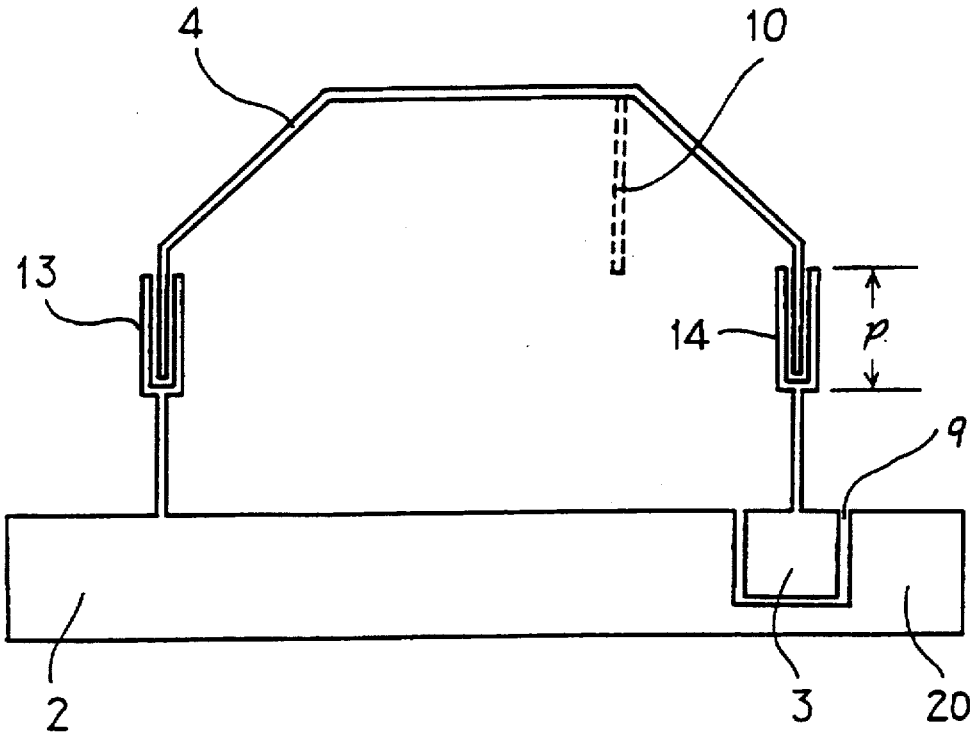
Figure 33A:
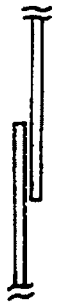
Figure 33B:
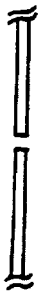
Figure 33C:
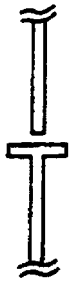
Figure 33D:
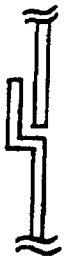
Figure 33E:
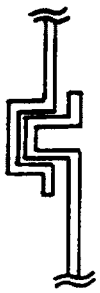
Figure 33F:
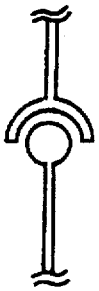
Figure 33G:
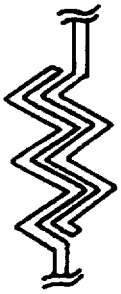
Figure 34:
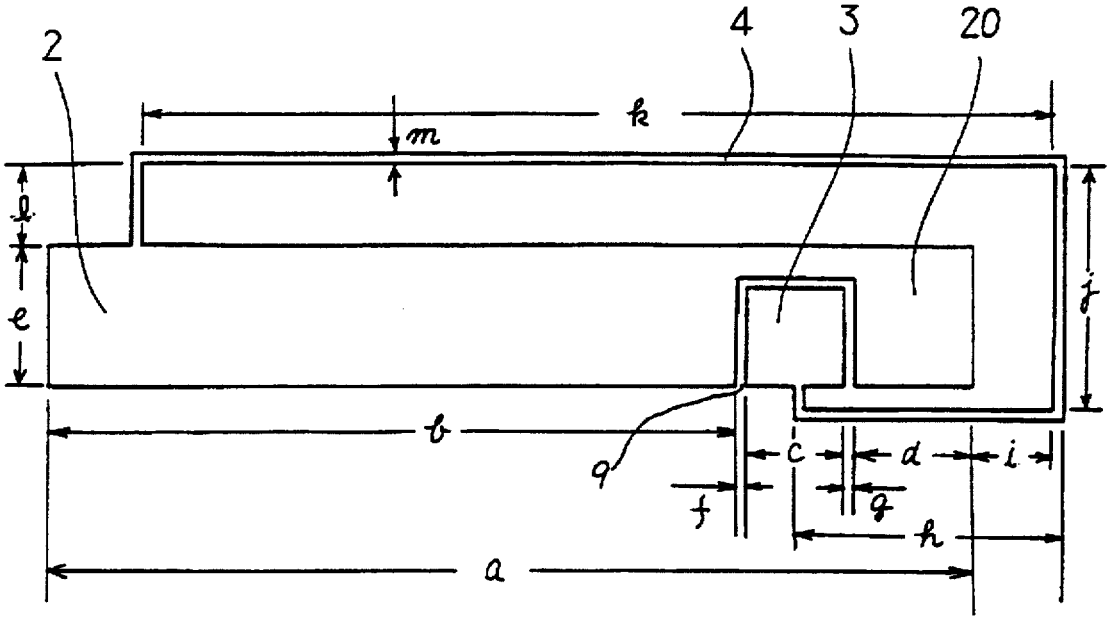

FIG. 30 is a front view showing embodiment 11;

FIG. 31 is a front view showing embodiment 12;

FIG. 32 is a front view showing embodiments 13 and 14;

FIGS. 33(*a*) through 33(*g*) are front diagrams showing variation examples of capacitive coupling portions 13 and 14 which are different from those in FIG. 30;

FIG. 34 is a front view showing embodiment 10; and

Figure 35:
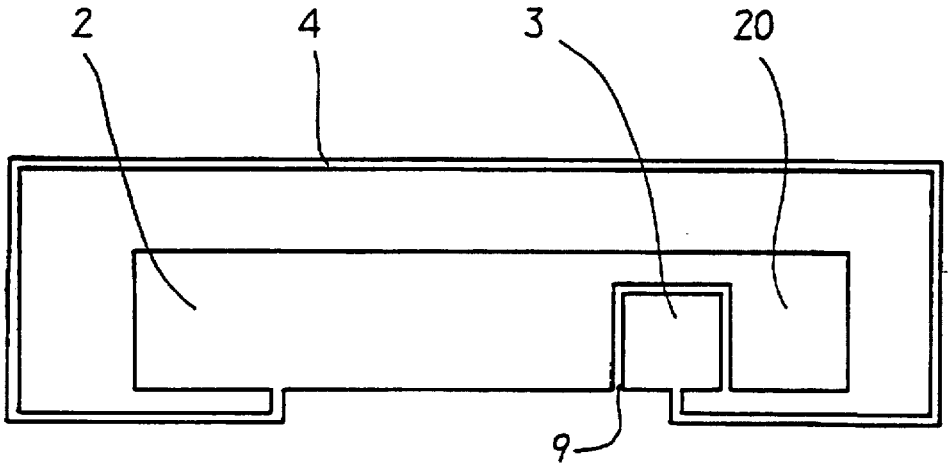

FIG. 35 is a front view showing a variation example of the high frequency wave glass antenna of FIG. 34.

DETAILED DESCRIPTION OF PREFERRED EMBODIMENTS

A detailed explanation will be given of this invention in accordance with the drawings as follows.

Figure 1:
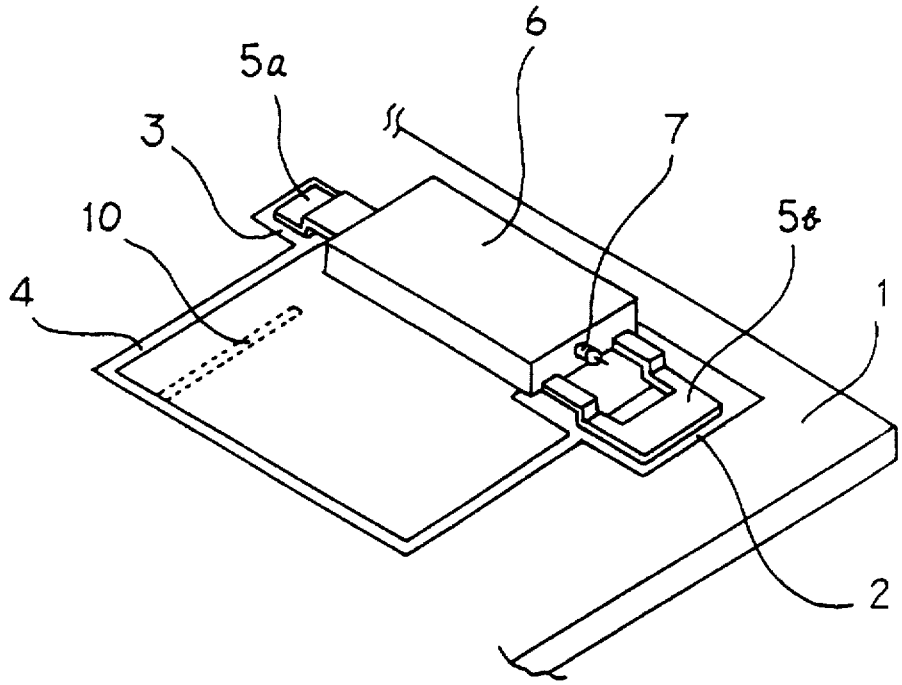
FIG. 1 is a perspective diagram showing the basic construction of a high frequency wave glass antenna of this invention.

FIG. 1 is a perspective diagram showing the basic construction of a high frequency wave glass antenna of this invention.

In FIG. 1, a notation 1 designates a glass plate of a window of an automobile, 2, a grounding conductor, 3, an electricity feeding portion, 4, an antenna conductor, 5*a* and 5*b*, legs of a case 6 accommodating a preamplifier circuit and 7, a junction terminal for sending a received signal to a receiver (not shown) and the like.

Figure 2:
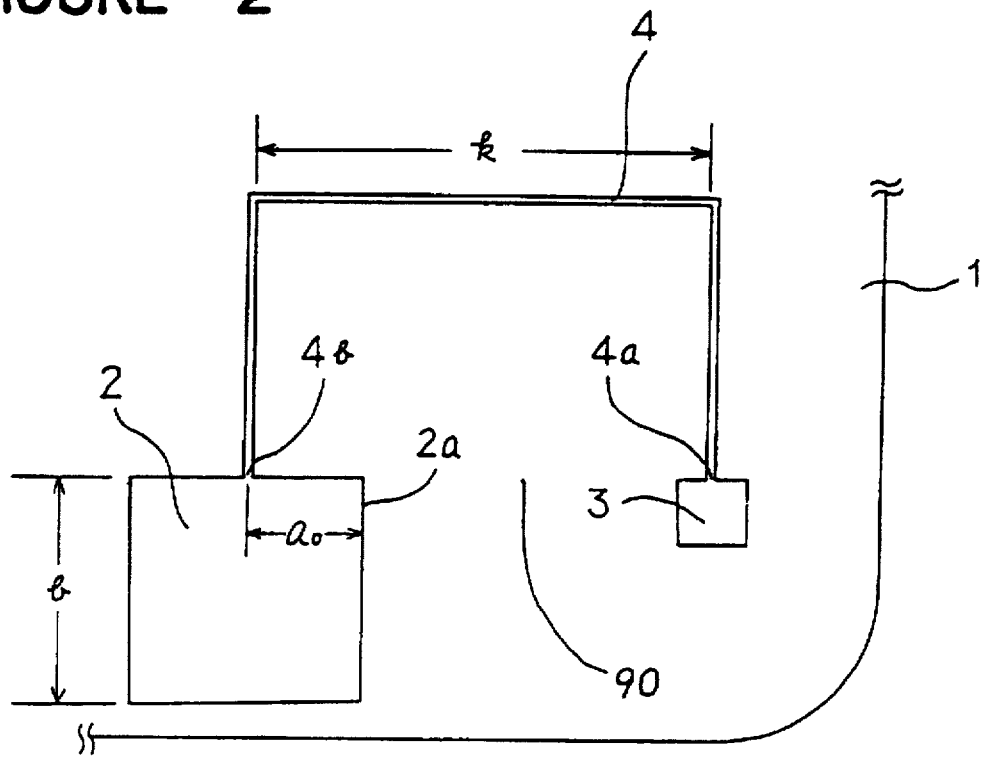
FIG. 2 is a front view of an antenna conductor and the like of the high frequency wave glass antenna of FIG. 1.

FIG. 2 is a front view of the grounding conductor 2, the electricity feeding portion 3 and the antenna conductor 4 shown in FIG. 1. In FIG. 2, notation 4*a* designates an end of the antenna conductor 4 on the side of the electricity feeding portion 3, 90, an opening portion of the antenna conductor 4, 4*b*, an end of the antenna conductor 4 on the side of the grounding conductor 2, k, an inner transverse width of the antenna conductor 4 and $a_o$, a distance between the end 4*b* (or a center of a line width of the antenna conductor 4) and the end 2*a*.

As shown in FIGS. 1 and 2, in the high frequency glass antenna of this invention, the line shape or strip shape antenna conductor 4 is provided on the glass plate 1 of a window of an automobile in an approximately circular, approximately elliptic or approximately polygonal form having the opening portion 90, one end of two ends at both sides of the antenna conductor 4 in the vicinity of the above opening portion 90 is connected to the electricity feeding portion 3 and the other end thereof is connected to the grounding conductor 2.

The received radiowave excited in the antenna conductor 4 is fed with electricity at the leg 5*a*, sent to a preamplifier circuit incorporated in the case 6 and is amplified thereby. The amplified output is inputted to a separately provided receiver through the junction terminal 7 and a cable connected to the junction terminal 7. The grounding conductor 2 and the leg 5*b* are connected to the ground of the receiver. Further, the power for driving the preamplifier circuit is supplied to the preamplifier circuit from the receiver through a coaxial cable and the junction terminal 7. Accordingly, the output of the preamplifier circuit and the power are superposed with each other. However, the method of power supply is not restricted to this example and may be substituted by another method. The preamplifier circuit includes not only a normally employed semiconductor amplifier circuit, but a resonance circuit, an impedance matching circuit and the like.

With respect to the shape of the antenna conductor 4, it is preferable that a line shape or a strip shape conductor pattern is of an approximately circular, approximately elliptic, approximately triangular or approximately polygonal shape. In case of the approximately triangular or polygonal shape, roundings may be provided at the apex portions. Further, although this invention is pertinent for receiving a radio wave in a frequency band of 300 MHz through 3 GHz, it is pertinent in view of the receiving characteristics that the length of the antenna conductor 4 is in a range of 45 through 150% of one wavelength of a received radiowave, more preferably in a range of 80 through 120%.

It is pertinent that the antenna conductor 4 is of a line shape or a strip shape and the width of the antenna conductor 4 is in a range of 0.2 through 5 mm. When the width is not larger than 0.2 mm, the formation thereof on the glass plate 1 is difficult, whereas, when it is larger than 5 mm, it is a hazard to the field of vision.

Figure 3:
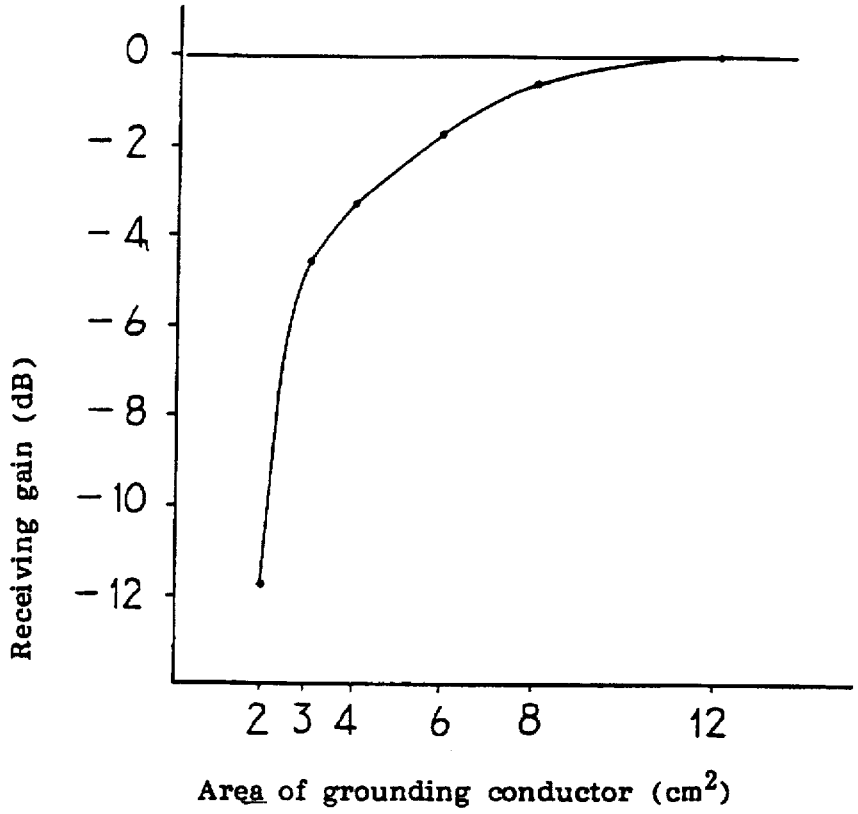
FIG. 3 is a characteristic diagram showing a relationship between a receiving gain and an area of a grounding conductor of a high frequency wave glass antenna of this invention.

When the antenna conductor 4 and the grounding conductor 2 are proximate to each other within a range of 0.1 mm to 20 mm, normally both are capacitively coupled. In the UHF band, the receiving gain is provided with a tendency of approximately a curve in FIG. 3, irrespective of the shape of the antenna conductor 4. The receiving characteristic of FIG. 3 is provided in a case wherein the antenna conductor 4 and the grounding conductor 2 are proximate to each other by a distance of 5 mm, and the width of the proximate portion is 10 mm. The receiving characteristic shown in FIG. 3 is significantly manifested especially when the antenna conductor 4 and the grounding conductor 2 are capacitively coupled.

Accordingly, the area of the grounding conductor 2 is necessary to be not smaller than 2.5 $cm^2$ in view of enhancing the receiving gain, more preferably not less than 6 $cm^2$ and especially preferably not less than 8 $cm^2$. Further, considering the miniaturization of the total of antenna, it is preferable that the area is not larger than 12 $cm^2$. However, there is a case wherein the area of the grounding conductor 2 is below 2.5 $cm^2$, depending on the shape of the grounding conductor 2 and the like, for instance, in case of FIG. 12 or the like, mentioned later.

With respect to the shape of the grounding conductor 2, the shape is not restricted to be quadrilateral, but may be approximately polygonal, approximately circular, approximately elliptic or the like. It is preferable that the distance $a_0$ between the end 4b (center of the line width of the antenna conductor 4) of the antenna conductor 4 and the end 2a of the grounding conductor 2 on the side of the electricity feeding portion 3, is long. That is, it is preferable that the grounding conductor 2 is extended toward the electricity feeding portion 3. This is because the effect of the electric image is made stronger. In case wherein the grounding conductor 2 is of an approximately rectangular shape, the relationship among the longitudinal width (b in FIG. 2) of the grounding conductor 2, the distance $a_0$ and the receiving gain is shown in the following Table. Cases are shown in the Table wherein the gain is designated in comparison with that of a case of 25% of the transverse width k.

In the following respective embodiments, the impedance of the junction terminal 7 per se is 50Ω. However, the impedance is not restricted to this value, and it is preferable to perform an impedance matching between the employed cable such as a coaxial cable and the output impedance of the preamplifier circuit.

Figure 4:
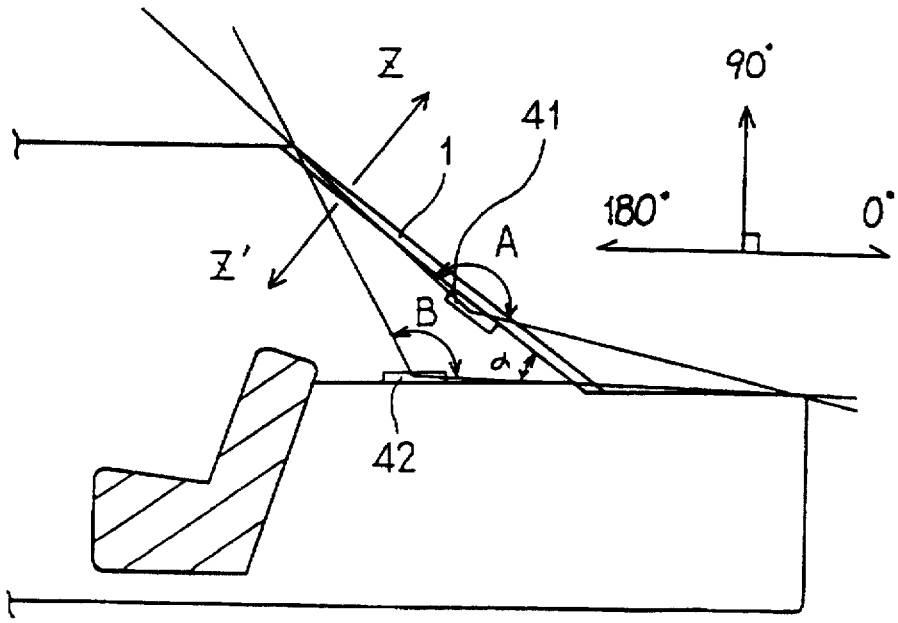
FIG. 4 is a sectional view wherein a high frequency wave glass antenna of this invention is provided on a glass plate of a rear window of an automobile.

FIG. 4 is a sectional diagram of a rear portion of an automobile, showing a relationship between an attaching portion of an antenna and a receiving range. Further, FIG. 5 is a perspective diagram wherein a high frequency wave glass antenna of this invention is provided on the glass plate 1 (inside of an automobile) of a rear window. In FIGS. 4 and 5, numeral 41 designates a high frequency wave glass antenna. In FIG. 4, the receivable range (angle) in the direction of the angle of elevation is A (deg). Numeral 42 designates a GPS antenna employing a conventional micro strip antenna, which is installed on the sun deck at the rear portion of a seat. The receivable range (angle) in case of the micro strip antenna 42 is B (deg), and the following relationship is established.

$$A>B$$

Further, in FIGS. 4 and 5, α designates an angle made by the glass plate 1 of the rear window and a horizontal line.

A detailed explanation will be given of Examples in accordance with the drawings as follows.

EXAMPLE 1

A high frequency wave glass antenna shown in FIGS. 1 and 2 was constructed.

In FIG. 1, numeral 10 designates a branch line having functions of adjusting impedance and the like which is provided in accordance with the necessity. However, the branch line was not provided in Example 1.

TABLE 1

| Length of distance | Longitudinal width of grounding conductor 2 | | | |
|---|---|---|---|---|
| $a_0$ | 5 mm | 10 mm | 15 mm | 20 mm |
| 50% of transverse width k | approx. ≧ 1 dB | approx. ≧ 1.5 dB | approx. ≧ 2.0 dB | approx. ≧ 2.3 dB |
| 100% of transverse width k | approx. ≧ 3.0 dB | approx. ≧ 3.5 dB | approx. ≧ 4.0 dB | approx. ≧ 4.3 dB |
| 120% of transverse width k | approx. ≧ 3.5 dB | approx. ≧ 4.0 dB | approx. ≧ 4.5 dB | approx. ≧ 4.8 dB |

As shown in the above Table, when the distance $a_0$ is long, the receiving gain is promoted. The tendency is manifested in the whole range of the UHF band. Further, this tendency is sustained almost irrespective of the shape of the antenna conductor 4. The tendency remains almost the same even when the shape of the grounding conductor 2 is of an approximately circular, approximately elliptic, approximately triangular shape or the like. Therefore, the distance $a_0$ is preferably not less than 50% of the transversed width k, more preferably not less than 100% and especially preferably not less than 120%.

With respect to the materials of the antenna conductor 4, the grounding conductor 2 and the electricity feeding portion 3, Ag (silver) is preferable. However, Ag—Pd (palladium), or other metal films can be employed. The film thickness of the antenna conductor 4 is preferably in a range of 10 μm through 200 μm. The material of the legs 5a and 5b may be brass, copper or other metals. The bonding of the legs 5a and 5b to the grounding conductor 2 and the electricity feeding portion 3 may be carried out by soldering or by employing an electricity-conductive adhesive agent or the like.

In Example 1, the antenna conductor 4 was designed with the purpose of receiving the GPS signal of 1,575.42 MHz. As the antenna, the antenna conductor 4 having a quadrilateral shape of 61 mm×61 mm (not including the electricity feeding portion 3 and the grounding conductor 2) was adopted. The quadrilateral shape of the antenna conductor 4 was devoid of a side, and the portion corresponding to the side was the opening portion 90 shown in FIG. 2. The antenna conductor 4 was formed by printing an Ag paste by the film thickness of approximately 50 μm and the line width of 1 mm and by curing it. The legs 5a and 5b and the electricity feeding portion 3 and the grounding conductor 2 which were connected to the ends of the opening portion 90 of the antenna conductor 4, were connected by a solder. The dimensions of the grounding conductor 2 were 30 mm×30 mm and the dimensions of the electricity feeding portion 3 were 10 mm×10 mm.

The case 6 was made of an epoxy resin and was provided with the dimensions of 50×16×4 mm. The legs 5a and 5b were made of a tin-plated brass and were provided with the plate thickness of 0.5 mm.

The junction terminal 7 was a coaxial type terminal having a structure wherein the inner conductor was covered with a resin and the resin was covered with an outer conductor, and was provided with a cylindrical shape having the diameter of 2.5 mm and the length of 4 mm and a characteristic impedance of 50Ω.

The preamplifier circuit was provided with the gain of 35 dB.

As shown in FIGS. 4 and 5, the high frequency wave glass antenna of embodiment 1 was installed on the glass plate 1 of a rear window of an automobile and its directivity was measured. In this case, α was 30°.

Figure 6:
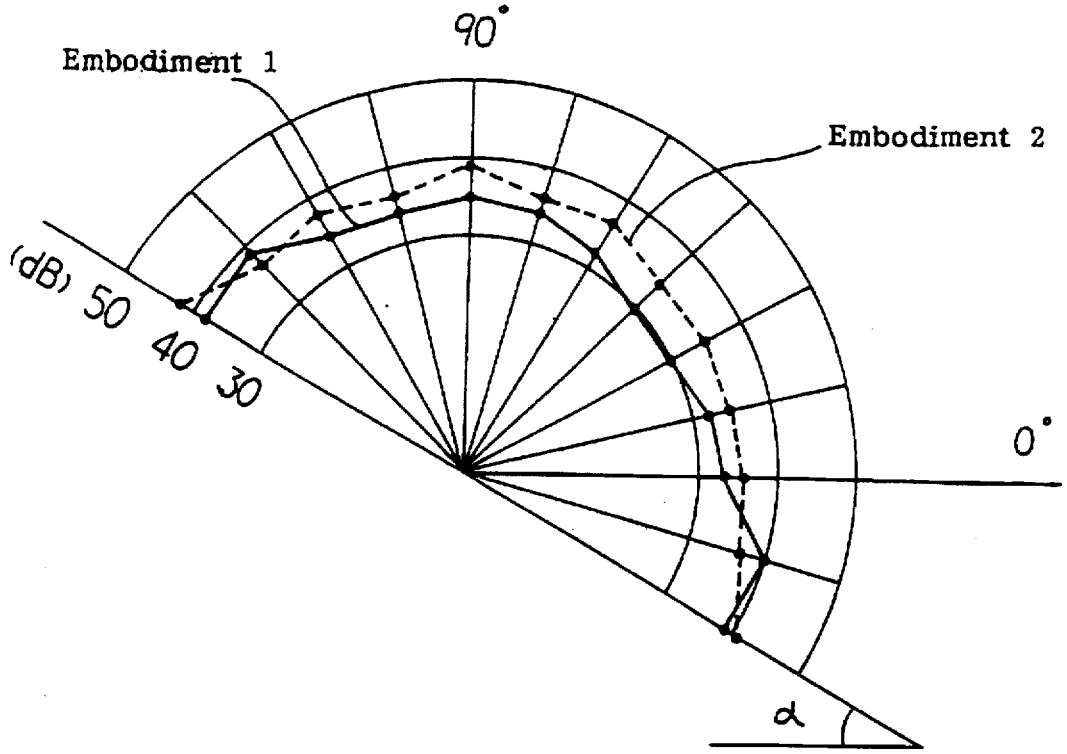
FIG. 6 shows characteristics diagrams of receiving gains of embodiments 1 and 2.
Figure 7:
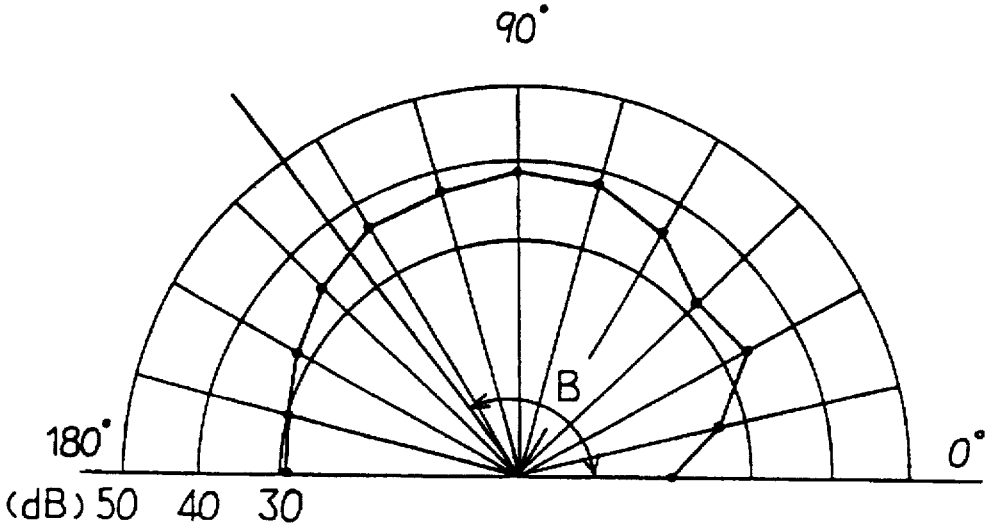
FIG. 7 is a characteristic diagram of a receiving gain of a GPS antenna using a conventional micro strip antenna.

FIG. 6 shows the directivity and the receivable range of embodiment 1 and FIG. 7, the receiving gain and the receivable range B of a Comparative Example (GPS antenna using a conventional micro strip antenna). The respective angles shown in FIGS. 6 and 7 agree with the angles shown in FIG. 4 in the front and back direction of an automobile, and shows the direction wherein the GPS satellite is present. For instance, in case of "0°" shown in FIGS. 4 and 6, the GPS satellite is present in the right direction in FIG. 4. This characteristic shows the gain in the dipole antenna ratio, which was formed by measuring an output voltage of the preamplifier circuit. According to this Example, it was found that the high frequency glass antenna of Example 1 was provided with a wide receivable range and the gain in the receivable range was excellent.

Further, with respect to the Comparative Example showing its directivity in FIG. 7, a micro strip antenna on sale which was manufactured by forming a rectangular conductor layer of 61×65 (mm) on one face of a fluororesin plate having the specific inductive capacity of 2.7 and the dimensions of 62×66×5 (mm) as the grounding conductor, and by forming a rectangular conductor layer having the dimensions of 53×56 (mm) on the other face thereof as the antenna conductor, was employed. The gain of the preamplifier circuit employed in the Comparative Example was the same as that in Example 1. The attaching of the micro strip antenna is performed as shown in the part 42 in FIG. 4.

In the following respective Examples, the material, the film thickness, and the forming method of the grounding conductor 2 and the like which were formed on the glass plate 1, the attaching method of the case 6 to the electricity feeding portion 3 and the like, and the other actual mounting method remain the same so far as a special description is not given.

EXAMPLE 2

A high frequency wave glass antenna was made under the specification of the same shape, dimensions, the method of attaching and the like as in Example 1, except providing the branch line 10 having the length of 30 mm to the antenna conductor 4. The reason why the branch line 10 was provided was that by providing the branch line 10, the impedance of the high frequency wave glass antenna was made variable, the impedance matching with the input impedance of the preamplifier circuit and the like which were connected to the next stage was facilitated, and the branch line 10 functioned as a reflector or a director thereby promoting a receiving sensitivity in a predetermined direction.

The impedance between the grounding conductor 2 and the electricity feeding portion 3 of Example 2 was composed of a resistance component of 35.2 Ω and a reactance component of 40.1 Ω, that is, 35.2-j40.1 Ω, and the impedance of Example 1 wherein the branch line was not provided was 19.3-j 14.7 Ω where j is $\sqrt{-1}$. Therefore, the impedance was found to change by the branch line 10.

Figure 8:
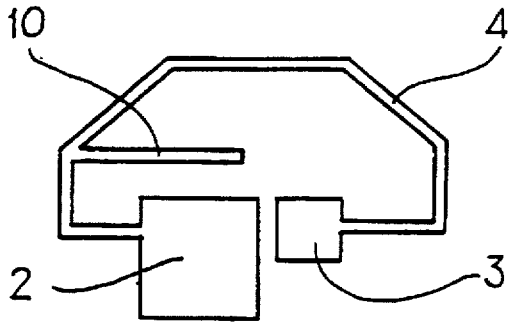
Figure 9:
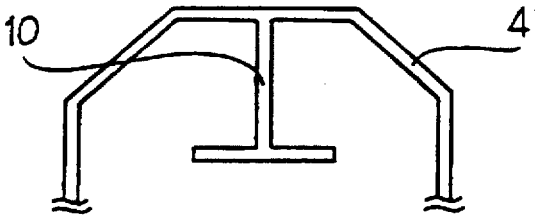
Figure 10:
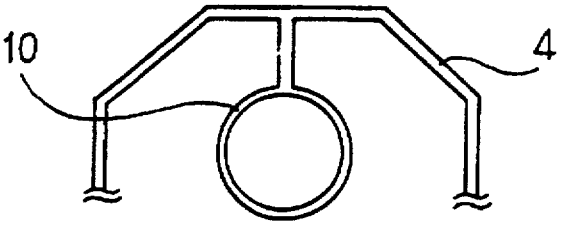
Figure 11:
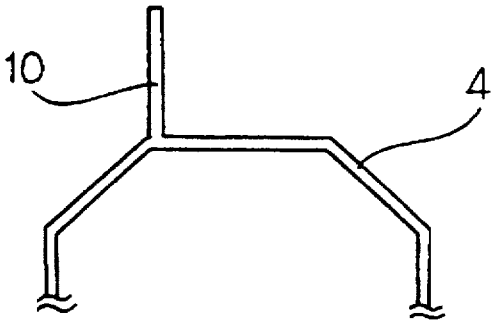

FIGS. 8 through 11 are variation examples of the antenna conductor 4 and the branch line 10. FIG. 8 shows an Example wherein the branch line 10 is extended in the left and right direction which is different from Example 2. FIG. 9 shows an Example wherein the branch line 10 is formed in an inverse T-shape. FIG. 10 shows an example wherein the branch line 10 is formed in a loop shape. FIG. 11 shows a case wherein the branch line 10 is provided outside the antenna conductor 4. Further, the branch line 10 is not restricted to a single piece, but may be composed of a plurality of pieces. Further, the branch line having a T-shape or a loop shape may be provided outside the antenna conductor 4 as in FIG. 11.

The branch line 10 can contribute to the promotion of the antenna gain and the like when it is provided either one of inside and outside of the antenna conductor 4. However, when the miniaturization thereof is necessary, it is preferable to provide the branch line 10 inside of the antenna conductor 4.

The shape of the branch line 10 is not restricted to a straight line. The branch line 10 per se may be provided with a loop shape, a circular shape or an elliptic shape, or a shape synthesized by a straight line or curve and a loop shape or the like. In case wherein a portion or a total Of the branch line 10 is provided with a loop shape or the like, the branch line 10 may be provided with an intermittent portion at a part thereof, or a shape having an opening portion.

The branch line 10 was connected to the antenna conductor 4 with respect to a direct current. However, the branch line 10 may be provided such that a portion thereof is disconnected and separated from the antenna conductor 4. In this case, when the distance between the branch line 10 and the antenna conductor 4 is 0.1 mm to 20 mm, since the branch line 10 and the antenna conductor 4 are capacitively coupled, it is possible to perform the impedance adjustment of the antenna conductor 2 by the branch line 10, and the branch line 10 functions as a reflector or a director.

When the distance between the branch line 10 and the antenna conductor 4 exceeds 20 mm, it is difficult to capacitively couple them, and the branch line 10 mainly functions only as a reflector.

The branch line 10 separated from the antenna conductor 4 in this way is called a reflector line.

The reason why the length of the branch line 10 was determined to be 30 mm in Example 2 shown in FIG. 1 was that by determining the length as (a quarter wave length of received radiowave)×(shortening ratio (0.6) of glass antenna), the influence on the impedance was enhanced. The length of the branch line is pertinent to be normally (a quarter wavelength of received radiowave)×(0.6)×(⅓ to 2). In Example 2, the line width of the branch line 10 was determined to be 1 mm which was the same as in the antenna conductor 4. However, the line width is preferable in a range of 0.2 mm to 5 mm.

The receiving gain with respect to Example 2 (high frequency wave glass antenna including the branch line (length: 30 mm) shown in FIG. 1) is described in FIG. 6 which is accompanied by the result of Example 1 (the characteristic in a dotted line indicates Example 2).

The branch line 10 which is not restricted to that in FIG. 1, and includes the variation examples and the like shown in FIGS. 8 through 11, is applicable to any shapes of the antenna conductor 4, the grounding conductor 2 and the electricity feeding portion 3. This is applicable to the following respective examples.

EXAMPLE 3

FIG. 12 is a front view showing Example 3, wherein portions having the same notation as in FIG. 1 are the same as in FIG. 1. Numeral 2 designates a strip shape grounding conductor having a predetermined region. A cut-off portion 9 is provided at a portion of the grounding conductor. Numeral 8 designates a coaxial cable for sending an output of an amplifier circuit to a receiver, and 20, an end conductor which is a portion of the grounding conductor.

Example 3 was designed with the purpose of receiving a signal from a GPS satellite having the frequency of 1,575.42 MHz. FIG. 13 is a front view showing the grounding conductor 2, the electricity feeding portion 3 and the antenna conductor 4 in Example 3, which are formed on the glass plate 1. The dimensions (unit: mm) of the grounding conductor 2 and the electricity feeding portion 3 are shown in Table 2.

TABLE 2

| a | b | c | d | e | f | g | h | i | j |
|---|---|---|---|---|---|---|---|---|---|
| 120 | 17 | 14 | 15 | 13 | 10 | 10 | 1 | 19 | 20 |

The grounding conductor 2 played the role of grounding with respect to the antenna conductor 4, and was provided with the operation of increasing the gain of antenna by the electric image method. The electricity feeding portion 3 was provided inside the cut-off portion of the grounding conductor 2, wherein the electricity feeding portion 3 was surrounded by the grounding conductor 2 from three directions. In this way, a signal received by the antenna conductor 4 was prevented from leaking outside at the electricity feeding portion 3.

FIGS. 14 through 16 show variation examples of the electricity feeding portion 3, the cut-off portion 9 and the end conductor 20. In FIGS. 14 through 16, the same notation is attached to the same portion in FIG. 12.

FIG. 14 shows a case wherein the cut-off portion 9 is extended in the transverse direction. FIG. 15 shows a case wherein the grounding conductor 2 is extended from front ends of the cut-off portion 9 in the vicinity of the opening portion, and protruding portions 200 are provided thereby surrounding the electricity feeding portion 3 by the grounding conductor 2 from four directions. In this case, the protruding portion or portions 200 may be provided at one end or both ends in the vicinity of the opening portion. FIG. 16 shows a case wherein the electricity feeding portion 3 is of a circular shape, wherein the cut-off portion 9 is provided with a shape corresponding thereto.

In FIGS. 12, 14 through 16, the total of the electricity feeding portion 3 is disposed inside the cut-off portion 9. However, a construction may be used wherein a part of the electricity feeding portion 3 is disposed inside the cut-off portion 9.

It is preferable that the width b of the grounding conductor 2 is not less than 5 mm. When the width is below 5 mm, the antenna gain will be lowered by 0.5 dB or more. Although the length a of the grounding conductor 2 depends on the shape of the antenna conductor 4, it is preferable that the value of "i" in FIG. 13 is not less than 5 mm, and "j" is not less than 10 mm. When the dimensions are provided with values below the respective limitations, the receiving gain will be lowered by approximately 0.5 dB or more. Although the upper limits of the dimensions of respective parts are not restricted in view of the receiving characteristic, the dimensions are restricted normally by the shape of the glass plate 1 and a positional relationship thereof with other objects mounted on the glass plate 1.

In Example 3, the line width of the antenna conductor 4 was designed to be 1 mm and the length of the antenna conductor 4 not including the electricity feeding portion 3 and the grounding conductor 2 was designed to be 90% of a propagation wavelength in air. In Example 3, the antenna 4 was of a pentagonal shape having an opening portion.

The high frequency wave glass antenna of Example 3 was attached to the glass plate 1 of a window under the specification in FIG. 4. $\alpha$ was determined to be 30°. FIG. 17 shows the characteristic diagram of the receiving gain for Example 3 as the gain in the dipole antenna ratio. This characteristic diagram was formed by measuring an output of a preamplifier circuit. Further, the characteristic shown in FIG. 17 is the one wherein the branch line 10 was not provided.

The respective angles shown in FIG. 17 agree with the angles shown in FIG. 4 in the front and rear direction of an automobile, which shows the direction of the presence of a GPS satellite.

EXAMPLE 4

A high frequency wave glass antenna was made under the specification of the same shape, dimensions and the like as in Example 3, except providing the branch line 10 having the length of 30 mm to the antenna conductor 4. The reason why the branch line 10 was provided was that, as in Example 2, by providing the branch line 10, the impedance of the high frequency wave glass antenna was made variable, the impedance matching of the input impedance of an amplifier and the like connected in the next stage, was facilitated, and the branch line 10 functioned as a reflector or a director, thereby promoting the receiving sensitivity in a predetermined direction.

The impedance of Example 4 was composed of a resistance component of 38.6 Ω and a reactance component of 37.3Ω, that is, 38.6–j37.3Ω, whereas the impedance of Example 3 wherein the branch line was not provided was 16.5–j16.4Ω. Therefore, it was found that the impedance was changed by the branch line 10.

The high frequency wave glass antennae of Example 3 and Example 4 in FIGS. 12 and 13 were attached to the glass plate 1 of a rear window of an automobile as in FIGS. 4 and 5. The characteristic diagrams of the receiving gains are shown in FIG. 18 as gains in the dipole antenna ratio. These characteristic diagrams were formed by measuring an output of a preamplifier circuit.

The angles of 90°, 0° and −90° shown in FIG. 18 respectively agree with the angles of 90°, 0° (vertical) and −90°, in FIG. 5. It was found that the gain was promoted as a result of the impedance matching by the branch line 10. With respect to the characteristic at −90°, Example 4 was superior to Example 3, and the branch line 10 functioned as a reflector or a director.

EXAMPLE 5

FIG. 19 shows Example 5. In FIG. 19, portions having the same notations as in FIG. 1 are the same portions in FIG. 1. In FIG. 19, numeral 8 designates a coaxial cable, and 11, an insular conductor. The material, the film thickness, the forming method of the grounding conductor 2 and the like which were formed on the glass plate 1 and the other actual mounting method, were the same as in Example 1. The material, the film thickness and the forming method of the insular conductor 11 were the same as in the grounding conductor or the like.

Example 5 was designed with the purpose of receiving a signal from a GPS satellite having the frequency of signal from a GPS satellite having the frequency of 1,575.42 MHz.

FIG. 20 is a front view showing the electricity feeding portion 2, the grounding conductor 3, the antenna conductor and the insular conductor 11 which were formed on the glass plate 1. The dimensions (unit: mm) of the respective portions are shown in Table 3.

TABLE 3

| k | m | n | p | q | r | s | t | u | v | w |
|---|---|---|---|---|---|---|---|---|---|---|
| 78 | 48 | 1 | 16 | 12 | 12 | 94 | 46 | 16 | 14 | 44 |

Further, a preamplifier circuit was provided on two layers of a circuit board. A grounding conductor of the preamplifier circuit having an approximately the same area as that of the insular conductor 11 was provided on a face thereof opposing the glass plate 1 of the circuit board, in a region opposing the insular conductor 11.

The grounding conductors of the insular conductor 11 and the preamplifier circuit were approximately parallel, and the distance between both was approximately 2 mm.

In Example 5, the width of the antenna conductor 4 was designed to be 1 mm, and the length of the antenna conductor 4 not including the electricity feeding portion 3 and the grounding conductor 2 was designed to be approximately 90% of a wavelength in air of a received radiowave. In Example 5, the antenna conductor 4 was provided with a quadrilateral shape having an opening portion 90.

The high frequency wave glass antenna in Example 5 was installed on the glass plate 1 of a rear window of an automobile as in FIGS. 4 and 5.

A Comparative Example wherein the insular conductor 11 was removed from the respective antenna pattern in FIGS. 19 and 20, was also provided on the glass plate 1 of a rear window as in the part 41 in FIGS. 4 and 5, and the characteristic of the receiving gain was measured as the gain in the dipole antenna ratio. The measurement was performed with respect to an output of the preamplifier circuit. As a result, the receiving gain of Example 5 was higher than that of the Comparative Example by approximately 3 to 4 dB, at the angle of 0° to 150°.

The insular conductor of this invention was provided for compensating for the shortage in the receiving sensitivity of the antenna conductor. The insular conductor shows an effect to some degree wherever it is provided, when the insular conductor is provided in a range wherein the insular conductor is capacitively coupled with a portion or a total of the preamplifier circuit. However, to further effectively promote the receiving sensitivity, it is preferable that the insular conductor is provided in a direction nearer to the coming side of a radiowave than the preamplifier side.

As stated above, the location of the insular conductor may be anywhere so far as it is in a range of capacitively coupling the insular conductor with the amplifier circuit. The insular conductor may be provided on the surface of the glass plate on which the antenna conductor and the like are provided, or the inside thereof, or the outside or the inside of a case or the like. However, if a stable receiving characteristic is preferred and in view of the productivity, it is preferable to provide the insular conductor on the glass plate.

In case wherein the insular conductor is provided in a case which accommodates the preamplifier circuit, the insular conductor may be provided at anywhere such as the outside or the inside surface of the case, a multi-layer circuit board for installing the preamplifier circuit or the like, parts installed inside of the case or the like.

A portion or a total of the case normally employs an insulating material such as a synthetic resin or a ceramics.

The insular conductor is not only of a single conductor pattern but of an aggregation of a plurality of conductor patterns. Further, the insular conductor may be attached with a conductor pattern of an approximately L shape, an approximately T shape, an approximately T shape, an approximately circular shape, an approximately polygonal shape or the like.

The area of the insular conductor is preferable not less than 100 $mm^2$, more preferably not less than 400 $mm^2$. When the area is below 100 $mm^2$, the insular conductor provides almost no contribution to the promotion of the receiving sensitivity. When the area is not less than 100 $mm^2$, there is an increase in the receiving sensitivity normally by 1 dB or more in case that a distance between the insular conductor and the grounding conductor of the preamplifier circuit is not larger than 5 mm and both are capacitively coupled. When the area is not less than 400 $mm^2$, there is the promotion in the receiving gain normally by 2 dB or more.

It is preferable that the insular conductor capacitively couples with the grounding conductor of the preamplifier circuit having a normal grounding pattern of the circuit board, or an input stage of a semiconductor composing the preamplifier circuit. However, there causes no trouble when the insular conductor is capacitively coupled with the other parts of the preamplifier circuit so far as there is no trouble of a crossed modulation distortion or the like. It is preferable in view of promotion of the receiving sensitivity to enlarge as much as possible the areas of the grounding conductor of the amplifier circuit and the conductor pattern of the input stage of a semiconductor which are capacitively coupled with the insular conductor. However, normally, when the area is not less than 50% of the area of the insular conductor, it contributes to the promotion of the receiving sensitivity by approximately 0.5 dB or more.

It is preferable that the distance between the insular conductor and the grounding conductor or the like of the preamplifier circuit is approximately 0.1 mm to 20 mm in case of the capacitive coupling. When the distance is below 0.1 mm, the manufacturing is difficult. When the distance exceeds 20 mm, there is almost no effect in view of the receiving sensitivity. The insular conductor and the amplifier circuit may be connected with respect to a direct current at a portion as in a point contact or a line contact, whereby the receiving sensitivity is not considerably deteriorated. Accordingly, there is a case wherein a complete capacitive coupling may not be required.

There is no clear understanding with respect to the operation wherein the receiving sensitivity is promoted by electrically connecting the insular conductor with the grounding conductor of the preamplifier circuit. There is also no clear understanding with respect to the operation wherein the receiving sensitivity is promoted when they are connected with respect to a direct current at their portions, which is not the capacitive connection between the insular conductor and the grounding conductor. However, in the high frequency region as in the UHF band, even when they are connected with respect to a direct current at their portions, it is considered that a capacitance (condenser component) is formed between the insular conductor and the preamplifier circuit thereby contributing to the enhancement of the receiving sensitivity.

EXAMPLE 6

FIG. 21 is a front view showing Example 6, wherein portions having the same notations in FIG. 12 are the same portions as in FIG. 12.

Example 6 was designed with the purpose of receiving a signal from a GPS satellite having the frequency of 1,575.42 MHz. The material, the film thickness, the forming method of the grounding conductor 2 and the like which were formed on the glass plate 1, and the other actual mounting method were the same as those in Example 1. The insular conductor 11 was the same as that in Example 5.

FIG. 22 is a front view showing the dimensions of the grounding conductor 2, the electricity feeding portion 3, the antenna conductor 4 and the insular conductor 11 formed on the glass plate 1. The dimensions (unit: mm) of the grounding conductor 2 and the electricity feeding portion 3 are shown in Table 4. Further, the distance between the grounding conductor 2 and the insular conductor 11 was determined to be 2 mm.

TABLE 4

| a | b | c | d | e | f | g | h | i | j | x | y |
|---|---|---|---|---|---|---|---|---|---|---|---|
| 120 | 17 | 14 | 15 | 13 | 10 | 10 | 1 | 19 | 20 | 36 | 12 |

FIGS. 23 and 24 show variation examples of the insular conductor 11 add the branch line 10. In FIGS. 23 and 24 portions having the same notations are the same portions in FIG. 12.

FIG. 23 shows an example wherein the insular conductor 11 is surrounded by the grounding conductor 2 from four directions and the branch line 10 is formed in an inverse T shape.

FIG. 24 shows an example wherein a T shape conductor is attached to the insular conductor 11 and a plurality of conductor lines are provided radially from the distal end of the line-shaped branch line 10.

The measurement was performed with respect to a high frequency wave glass antenna showing. Example 6 wherein the branch line 10 in FIG. 21 was not provided, and a Comparative Example, under the specification of attaching as in the part 41 in FIGS. 4 and 5.

In the Comparative Example, the grounding conductor. 2 was formed in the area of forming the insular conductor 21 and the area of not forming a conductor between the grounding conductor 2 and the insular conductor 1 in FIG. 21, and the branch line 10 was not provided. The result is shown in FIG. 25 as the dipole antenna ratio.

EXAMPLE 7

A high frequency wave glass antenna was made with the same shape, dimension and the like as in Example 6 except providing the branch line 10 having the length of 30 mm shown in FIG. 21 to the antenna conductor 4.

As the result of measuring the receiving gain by the same method as in Example 6, the receiving sensitivity of Example 7 was higher than that of Example 6 by approximately 1 through 4 dB in the whole range of 0° C. through 150°.

EXAMPLE 8

FIG. 26 shows Example 8.

In FIG. 26, portions having the same notations as in FIG. 1 are the same portions as in FIG. 1.

As shown in FIG. 26, the high frequency wave glass antenna of Example 8 is provided with a loop shape conductor 12 at the antenna conductor 4, which is characterized by providing the loop portion at a part of the antenna conductor 4.

In Example 8, the antenna conductor 4 was designed with the purpose of receiving a GPS signal having the frequency of 1,575.42 MHz.

The shapes and the dimensions of the antenna conductor 4, the grounding conductor 2 and the like were the same as in Example 1 (FIG. 1) except those of the loop shape of the conductor 12. Further, the material, the film thickness and the forming method of the grounding conductor 2 and the like which were formed on the glass plate 1, or other actual mounting method were the same as in Example 1. The length (of a portion not including the antenna conductor 4) of the loop shape conductor 12 was determined to be 40 mm.

The high frequency wave glass antenna of Example 8 was installed on the glass plate of a rear window of an automobile as in FIGS. 4 and 5.

The receiving gain of the high frequency wave glass antenna in Example 8 was higher than that of a Comparative Example wherein the loop shape conductor 12 in FIG. 26 was not provided, by approximately 2 dB with respect to a mean value in the receivable range.

EXAMPLE 9

FIG. 27 is a front view showing a high frequency wave glass antenna of Example 9, wherein portions having the same notations as in FIG. 1 are the same portions in FIG. 1.

In Example 9, the antenna conductor 4 was designed with the purpose of receiving a GPS signal of 1,575.42 MHz.

Numeral 12 designates a loop shape conductor attached to the antenna conductor 4. The forming condition of the antenna conductor 4 and the like such as the material, the film thickness and the like were the same as in Example 1. Numeral 20 designates an end conductor.

As in Example 1, the preamplifier circuit was accommodated in an insulating box and provided on the grounding conductor 2 and the electricity feeding portion 3 as in Example 1. The dimensions (unit: mm) of the respective portions are shown in Table 5.

TABLE 5

| a | b | c | d | e | f | g | h |
|---|---|---|---|---|---|---|---|
| 36 | 28 | 42 | 28 | 36 | 12 | 31 | 21 |

When the wavelength of a received radiowave is defined as $\lambda_0$, the following relationship is established.

$$\lambda_0 = C/f_r$$

where C is a light speed and $f_r$, the frequency of the received radiowave.

When the shortening ratio of wavelength on a glass plate is determined to be 0.6, the wavelength $\lambda_g$ on the glass plate is determined as follows.

$$\lambda_g = 0.6 \times \lambda_0 \sim 114 \text{ (mm)}$$

The antenna conductor container 4 was a loop shape antenna having an opening portion (the opening portion was in the vicinity of the cut-off portion 9). When the length (a+b+c+d+e) from a point A to a point B is defined as $L_1$, $L_1$=170 mm. Further, when the length of the closed loop made by the loop shape conductor 12 is defined as $L_2$, $L_2$=b+f+g+h=91 mm. That is, a synthetic antenna was formed wherein the two loop shape antennae having different loop lengths were synthesized by the antenna conductor 4 and the loop shape conductor 12.

With respect to the directivity of the antenna having the length of $L_1$, the receiving sensitivity decreased in a direction perpendicular to the glass plate 1 (Z and Z' direction in FIG. 4), and increased in the other direction. On the other hand, with respect to the directivity of the antenna having the length of $L_2$, the receiving sensitivity increased in the Z and Z' direction and decreased in the other direction. Accordingly, both antennae compensated for each other with respect to the directions wherein the receiving sensitivity decreased thereby forming the synthesized antenna.

The above operation and effect are applicable to Example 8, and applicable to the other Examples in case wherein the loop shape conductor is applied to the other Example.

The measurement was performed with respect to the high frequency wave glass antenna shown in Example 9, under the specification of attaching as in FIGS. 4 and 5. As a Comparative Example, a case was employed wherein the loop shape conductor 12 was removed from the high frequency wave glass antenna of Example 9 shown in FIG. 27. The result is shown in FIG. 28 in the dipole antenna ratio. Further, the characteristic diagrams in FIG. 28 were formed by measuring an output of a preamplifier circuit.

EXAMPLE 10

FIG. 29 is a perspective diagram showing a high frequency wave glass antenna of Example 10, wherein portions having the same notations as in FIG. 1 are the same portions in FIG. 1.

In FIG. 29, numeral 21 designates a separated conductor, and 21*a*, an extended portion of the separated conductor.

As shown in FIG. 29, the high frequency wave glass antenna of Example 10 is characterized by providing the antenna conductor 4 and the separated conductor 21 which is insulated from the grounding conductor 2 with respect to a direct current, in the vicinity of the electricity feeding portion 3 and a portion of the antenna conductor 4 proximate to the electricity feeding portion 3.

In Example 10, the antenna conductor 4 was designed with the purpose of receiving a GPS signal of 1,575.42 MHz.

The size of the separated conductor 21 was 30 mm×16 mm and the distance between the separated conductor 21 and the electricity feeding portion 3 was 1.0 mm.

The dimensions of the grounding conductor 2 were 16 mm×16 mm and the dimensions of the electricity feeding portion 3 were 10 mm×10 mm. Further, the material, the film thickness, the forming method of the grounding conductor 2 or the like which were formed on the glass plate 1 or the other actual mounting method, were the same as in Example 1. The material, the film thickness, the forming method and the like of the separated conductor 21 were the same as in the grounding conductor 2 and the like.

The receiving gain of the high frequency wave glass antenna wherein the extended portion 21*a* was not provided in FIG. 29, of Example 10, was higher than that of a Comparative Example wherein the separated conductor 21 and the extended portion 21*a* in FIG. 29 were not provided, by approximately 2 dB with respect to a mean value in the receivable range.

The extended portion 21*a* was pertinently provided in accordance with the change of the shape of the antenna conductor 4 or the like.

The separated conductor 21 and the extended portion 21*a* played the role of an auxiliary antenna, wherein a receiving signal excited at the separated conductor 21 or the like was sent to the electricity feeding portion 3 by the capacitive coupling. Accordingly, it is necessary to provide the separated conductor 21 and the extended portion 21*a* in the vicinity of the electricity feeding portion 3.

The distance between the separated conductor 21 or the extended portion 21*a* and the electricity feeding portion 3 or the antenna conductor 4 in the vicinity of the electricity feeding portion 3 does not show an effect when the distance is outside the range of the capacitive coupling. In consideration of easiness forming and the like, the distance is preferably approximately 0.2 to 20 mm, more preferably 0.2 to 5 mm.

It is preferable that the area of the separated conductor 21 is not smaller than 25 $mm^2$. When the area is below 25 $mm^2$, the receiving gain is not promoted by approximately 0.5 dB or more.

The shape of the separated conductor 21 is not restricted to a polygonal shape, but may be a lattice shape, a circular shape, an elliptic shape or the like, whereby the separated conductor 21 functions as an auxiliary antenna. To strengthen the capacitive coupling, the opposing portions of the separated conductor 21 or the extended portion 21*a* and the electricity feeding portion 3 or the antenna conductor 4 may respectively of a saw shape, a rugged shape (protrusion and recess) or the like in view of fitting. The separated conductor 21 and the extended portion 21*a* are applicable to the other embodiments.

EXAMPLE 11

FIG. 30 is a front view showing Example 11. Example 11 was designed with the purpose of receiving a signal from a GPS satellite having the frequency of 1,575.42 MHz.

The film thickness, the forming method and the like of the antenna conductor 4 and the like as were the same as in Example 10. The dimension (unit: mm) of the respective portions are shown in Table 6.

TABLE 6

| a | b | c | d | e | f | g | h | i | j | k | l | m |
|---|---|---|---|---|---|---|---|---|---|---|---|---|
| 140 | 94 | 33 | 1 | 11 | 1 | 17 | 11 | 17 | 3 | 3 | 19 | 39 |

The receiving gain of the case wherein the separated conductor 21 was provided (FIG. 30) as in Example 11, was larger than that of a case wherein the separated conductor 21 was not provided, by approximately 3 dB with respect to a mean value in the receivable range.

EXAMPLE 12

FIG. 31 is a front view showing a high frequency wave glass antenna of Example 12, wherein the portions having the same notations as in FIG. 1 are the same portions as in FIG. 1.

In FIG. 31, numeral 22 designates a protrusion provided on the grounding conductor 2 for attaching the leg 5*b* of the case 6 in FIG. 1.

There is a case wherein the protrusion 22 not only contributes to attaching the leg 5b, but widening the area of the grounding conductor 2 and to promoting the receiving sensitivity, depending on the position for provision. In case wherein the leg 5b is directly attached to the grounding conductor 2, the protrusion 22 is not necessary.

Example 12 was designed with the purpose of receiving a signal from a GPS satellite having the frequency of 1.575.42 MHz.

As shown in FIG. 31, in the high frequency wave glass antenna of Example 12, the grounding conductor 2 and the electricity feeding portion 3 are proximate to each other to a degree wherein the both are capacitively coupled, and the transverse width of the grounding conductor 2 is longer than the inner transverse width k of the antenna conductor 4.

The dimensions of the respective portions of the FIG. 31 are shown in Table 7 (unit: mm).

TABLE 7

| a | b | c | d | e | f | g | h | i | j | k |
|---|---|---|---|---|---|---|---|---|---|---|
| 120 | 17 | 10 | 20 | 13 | 12 | 12 | 1 | 19 | 19 | 80 |

The length of the antenna conductor 4 (a portion not including the protrusion 22 and the electricity feeding portion 3) was determined to be 183 mm.

In Example 12, the distance h between the grounding conductor 2 and the electricity feeding portion 3 was determined to be 1 mm. When h was large, the receiving sensitivity would be lowered.

Further, when the length (g in FIG. 31) of a proximate portion of the electricity feeding portion 3 and the grounding conductor 2 was small, the receiving sensitivity will be lowered. When the proximate portion is approximately linear and the electricity feeding portion 3 and the grounding conductor 2 are approximately parallel with each other at the proximate portion, a number of kg is defined as, kg=The length of the proximate portion (g)/The distance at the proximate portion (h), and when kg is not smaller than 3, an effect wherein the receiving gain is promoted by not smaller than approximately 0.5 dB, which is preferable. When kg is not less than 5, an effect wherein the receiving gain is promoted by not less than approximately 1 dB can be provided, which is more preferable.

Such an operation is applicable to the case wherein the cut-off portion 9 is provided in the grounding conductor 2 as shown in FIG. 12 and the like.

Further, to strengthen the capacitive coupling, a shield conductor 23 may be provided to the grounding conductor 2. The shield conductor is applicable to the other examples shown in FIGS. 1 and 2 and the like.

The receiving gain of Example 12 wherein the shield conductor 23 was not provided, was promoted compared with a Comparative Example wherein h was determined to be 25 mm in FIG. 31, by approximately 3 dB in the receivable range.

EXAMPLE 13

FIG. 32 shows a high frequency wave glass antenna of Example 13. In FIG. 32, portions having the same portions in FIG. 12 are the same portions as in FIG. 12. Numerals 13 and 14 designate capacitive coupling portions of the antenna conductor 4. The specification other than the antenna conductor 4 such as the shape and the like of the grounding conductor 2 and the like are the same as in Example 3. The length (p) of the capacitive coupling portion 14 was determined to be 16 mm and similarly, the length of the capacitive coupling portion 13 was determined to be 16 mm.

The receiving characteristic of the high frequency wave glass antenna wherein the branch line was not included in FIG. 32, of Example 13, was approximately equivalent to that in Example 3.

EXAMPLE 14

A high frequency wave glass antenna having the same specification as in Example 13 except providing a branch line 10 having the length of 30 mm to the antenna conductor 4, was made (FIG. 32). The receiving gain was approximately equivalent to that in Example 4.

The capacitive coupling portions 13 and 14 of the antenna conductor 4 with respect to Examples 13 and 14 can adjust the antenna impedance in accordance with the sizes of the capacitances or the providing locations of the capacitive coupling portions 13 and 14 and the number of capacitive coupling portions. Therefore, it is easy to perform the impedance matching between the input impedance of the preamplifier circuit and the antenna impedance. Further, the directivity can be operated to adjust since the current distribution in the antenna conductor 4 can be controlled.

The capacitive coupling portion is applicable to the other Examples. In Examples 13 and 14, two capacitive coupling portions were provided. However, the number of the capacitive coupling portions are not limited to this Example and the capacitive coupling portion or portions can be provided at one location or at more than three locations. Further, the shape of the capacitive coupling portion is not limited to the shape shown in FIG. 32, and the shapes in FIGS. 33(*a*) through 33(*g*) and the like can be employed.

EXAMPLE 15

FIG. 34 shows a high frequency wave glass antenna of Example 15. In the high frequency wave glass antenna of FIG. 34, the vertical dimension (j) in FIG. 34 of the total antenna can be shortened than that in FIG. 12, thereby achieving the miniaturization.

In FIG. 34, the same notation as in FIG. 12 designates the same portion.

As shown in FIG. 34, in the high frequency glass antenna of Example 15, the antenna conductor 4 is provided such that the antenna conductor 4 surrounds at least a portion of the grounding conductor 2.

The dimensions of the respective portions are shown in Table 8 (unit: mm).

TABLE 8

| a | b | c | d | e | f | g | h | i | j | k | l | m |
|---|---|---|---|---|---|---|---|---|---|---|---|---|
| 110 | 82 | 12 | 14 | 17 | 1 | 1 | 32 | 10 | 30 | 109 | 10 | 1 |

The other specification was the same as in Example 3.

The receiving sensitivity of the high frequency wave glass antenna of Example 15 was approximately equivalent to that in Example 3.

As a variation example of the high frequency wave glass antennae in FIG. 34, a construction as shown in FIG. 35 or the like is exemplified. The grounding conductor 2 was provided with the cut-off portion 9 in FIG. 34 or 35.

However, the shapes of the antenna conductors 4 shown in FIGS. 34 and 35 are applicable to the grounding conductor 2 shown in FIG. 31 wherein the cut-off portion 9 is not provided.

EXAMPLE 16

A construction having the same specification with those of the high frequency wave glass antennae of Examples 1 through 15 except the antenna conductor 4 was made. The line width of the antenna conductor 4 was determined to be 1 mm, and the length of the antenna conductor 4 not including the electricity feeding portion 3 and the grounding conductor 2, was determined to be 90% of a propagation wavelength in air of each received radiowave. In this way, seven sets of high frequency wave glass antennae having the antenna conductors 4 with lengths corresponding to the respective frequencies of 300 MHz, 500 MHz, 750 MHz, 1.0 GHz, 2.0 GHz, 2.5 GHz, and 3.0 GHz, were made. Further, seven sets of preamplifiers each having the receiving gain which was approximately equal to those of the preamplifier circuits employed in Example 1 and the like, were made with respect to the above frequencies, and employed in combination of the respective high frequency wave glass antennae made as above. When the receiving gains were measured at the corresponding receiving frequencies, the receiving gains were found to be in a range of approximately 35 through 45 dB in the dipole antenna ratio, and the receiving was performed under excellent conditions.

EXAMPLE 17

When the sending was performed by employing the antenna patterns of the respective high frequency wave glass antennae of Examples 1 through 16, it was found possible to perform the excellent sending with respect to the frequencies corresponding to the respective antenna conductors.

In this invention, the miniaturization thereof as an antenna device can be achieved, since an antenna conductor provided on a glass plate of a window of an automobile is employed as the antenna. Further, the receiving can be performed with an excellent receiving sensitivity in a wide frequency range of approximately 300 MHz through 3 GHz, and a further wider receiving angle range can be provided. Further, an effect is recognized wherein the invention does not spoil the design of an automobile and the danger of robbery is minimized since it is possible to install the invented antennae in a car room.

When a branch line is provided, an effect is shown wherein a signal received by an antenna conductor can efficiently be sent to a preamplifier or the like by changing the antenna impedance by the branch line thereby performing the impedance matching with the inputs impedance of the preamplifier or the like. An effect is also recognized wherein an extended branch line plays the role of a director or a reflector of the antenna conductor, thereby promoting the receiving sensitivity.

Further, in this invention, an electric image is caused by a grounding conductor having a predetermined area, thereby promoting the receiving sensitivity.

Further, the receiving gain can be promoted by several dBs, by approaching the antenna conductor and the grounding conductor to each other, or by providing a cut-off portion in the grounding conductor and providing an electricity feeding portion in the cut-off portion.

Further, when an insular conductor is provided at a predetermined location, the receiving gain can be promoted by several dBs in comparison with a case wherein the insular conductor is not provided.

Further, the directivity can be improved when a loop shape conductor is provided whereby a portion of the antenna conductor is in a loop-like shape, since a synthesized antenna is formed.

Further, the receiving gain can be promoted by several dBs, when a separate conductor is provided at a predetermined location, in comparison with a case wherein the separate conductor is not provided.

Further, it is easy to perform the impedance matching with an input impedance of a preamplifier circuit and the like, in case wherein a capacitive coupling portion or portions are provided in the antenna conductor.

What is claimed is:

1. A high frequency wave glass antenna for an automobile comprising:

an active line shaped antenna provided on a glass plate of a window of an automobile, said line shape antenna having a shape selected from the group consisting of a circular, elliptic and a polygonal shape, said line shape antenna having an opening portion enclosed by said line shape antenna and having two ends forming a mouth of said opening, the length of said line shape antenna being in a range of from 45 to 150% of one wavelength of a received radio wave, a first end of said two ends of the line shape antenna is connected to an electricity feeding portion and a second end of said two ends is connected to a grounding conductor; and wherein an area of the grounding conductor is not smaller than 2.5 $cm^2$.

2. The high frequency wave glass antenna for an automobile according to claim 1, wherein the line shape antenna is provided such that at least a portion of the grounding conductor is surrounded by the line shape antenna.

3. The high frequency wave glass antenna for an automobile according to claim 1, wherein a portion of the electricity feeding portion is provided in a cut-off portion formed in a region of the grounding conductor and an said insular conductor is electrically connected to the preamplifier circuit.

4. The high frequency wave glass antenna for an automobile according to claim 1, wherein a branch line is provided in the line shape antenna.

5. The high frequency wave glass antenna for an automobile according to claim 1, wherein a loop shape conductor is provided in the line shape antenna thereby providing a loop portion at a portion of the line shape antenna.

6. The high frequency wave glass antenna for an automobile according to claim 1, wherein a plurality of separated conductors are provided on the glass plate of a window, the separated conductors being capacitively coupled with the electrical feeding portion and the line shape antenna in the vicinity of the electrical feeding portion.

7. The high frequency wave glass antenna according to claim 1, wherein a branch line, a loop shape conductor and a capacitive coupling portion are provided in the line shape antenna.

8. The high frequency wave glass antenna for an automobile according to claim 1, wherein a branch line, a loop shape conductor and a capacitive coupling portion are provided in the line shape antenna and a plurality of separated conductors provided on the glass plate of a window the separated conductors being capacitively coupled with the electrical feeding portion and the line shape antenna in the vicinity of the electrical feeding portion.

9. The high frequency wave glass antenna for an automobile according to claim 1, further comprising:

a preamplifier circuit provided on the glass plate of a window for amplifying a signal received by the line shape antenna.

10. The high frequency wave glass antenna for an automobile according to claim 1, further comprising:

a preamplifier circuit provided on the glass plate of a window for amplifying a signal received by the antenna conductor; and wherein the electricity feeding portion and the line shape antenna in the vicinity of the electricity feeding portion are capacitively coupled to the grounding conductor.

11. The high frequency wave glass antenna for an automobile according to claim 1, wherein a cut-off portion is provided in the grounding conductor; the total or a part of the electricity feeding portion is in the cut-off portion, and the gravity center of the grounding conductor is out of the cut-off portion.

12. The high frequency wave glass antenna for an automobile according to claim 1, wherein a cut-off portion is provided in the grounding conductor; the total or a part of the electricity feeding portion is in the cut-off portion, and the gravity center of the grounding conductor is out of the electricity feeding portion.

13. The higher frequency wave glass antenna for an automobile according to claim 1, wherein a cut-off portion is provided in the grounding conductor; the total or a part of the electricity feeding portion is in the cut-off portion, and the gravity center of the grounding conductor is not in the vicinity of the gravity center of the electricity feeding portion.

14. The high frequency wave glass antenna for an automobile according to claim 1, wherein a substantial portion of the line shape antenna is at a side of a line connecting the gravity center of the grounding conductor to the gravity center of the electricity feeding portion.

15. The high frequency wave glass antenna for an automobile according to claim 1, wherein the line shape antenna does not have any portions which are proximate to each other in a range of a capacitive coupling.

16. The high frequency wave glass antenna for an automobile according to claim 1, wherein the line shape antenna does not have an outwardly curved portion with respect to the center of the line shape antenna.

17. The high frequency wave glass antenna for an automobile according to claim 1, wherein a received radiowave is 300 MHZ-3 GHz.

18. A high frequency wave glass antenna for an automobile comprising:

an active line shape antenna provided on a glass plate of a window of an automobile, said line shape antenna having a shape selected from the group consisting of a circular, elliptic and a polygonal shape, said line shape antenna having an opening portion enclosed by said line shape antenna and having two ends forming a mouth of said opening, the length of said line shape antenna being in a range of 45 through 150% of one wavelength of a received radio wave, a first end of said two ends of the line shape antenna is connected to an electricity feeding portion and a second end of said two ends is connected to a grounding conductor; and wherein the electricity feeding portion and the line shape antenna in the vicinity of the electricity feeding portion are capacitively coupled to the grounding conductor.

19. The high frequency wave glass antenna for an automobile according to claim 18, wherein a total or a portion of the electricity feeding portion is provided in a cut-off portion formed in a region of the grounding conductor.

20. The high frequency wave glass antenna for an automobile according to claim 19, and said antenna further comprising:

a receiving signal caused between the line shape antenna and the grounding conductor is sent to a receiver after amplifying the receiving signal by tree amplifier circuit provided on the glass plate of a window.

21. The high frequency wave glass antenna for an automobile according to claim 18, wherein a total or a portion of the electricity feeding portion is provided in a cut-off portion formed in a region of the grounding conductor and the line shape antenna is provided such that at least a portion of the grounding conductor is surrounded by the line shape antenna.

22. The high frequency wave glass antenna for an automobile according to any one of claim 18, wherein a cut-off portion is provided in the grounding conductor; the total or a part of the electricity feeding portion is in the cut-off portion, and the end of the line shape antenna to a side of the electricity feeding portion is in the vicinity of the mouth of opening of the cut-off portion.

23. The high frequency wave glass antenna for an automobile according to claim 18, wherein a received radiowave is 300 MHZ-3 GHz.

24. A high frequency wave glass antenna for an automobile comprising:

a line shape antenna provided on a glass plate of a window of an automobile, said line shape antenna having a shape selected from the group consisting of a circular, elliptic and a polygonal shape, said line shape antenna having an opening portion enclosed by said line shape antenna and having two ends forming a mouth of said opening, the length of said line shape antenna being in a range of 45 through 150% of one wavelength of a received radio wave, a first end of said two ends of the line shape antenna is connected to an electricity feeding portion and a second end of said two ends is connected to a grounding conductor; and wherein a transverse distance between a point where the grounding conductor contacts the second end of the line shape antenna to a side of the grounding conductor closest to the electricity feeding portion is not smaller than 50% of an inner transverse width of the line shape antenna.

25. The high frequency wave glass antenna for an automobile according to any one of claim 1 through claim 24, further comprising: a capacitive coupling portion provided in the line shape antenna.

26. The high frequency wave glass antenna for an automobile according to any one of claim 1 through 24, wherein a substantial portion of the line shape antenna is in an area other than the area surrounded by the grounding conductor and the electricity feeding portion, on the glass plate.

27. The high frequency wave glass antenna for an automobile according to any one of claim 1 through 24, wherein a cut-off portion is provided in the grounding conductor; the total or a part of the electricity feeding portion is in the cut-off portion, and the end of the line shape antenna to a side of the electricity feeding portion is out of the cut-off portion.

28. The high frequency wave glass antenna for an automobile according to any one of claim 1 through 24, wherein a cut-off portion is provided in the grounding conductor; the total or a part of the electricity feeding portion is in the cut-off portion, and the end of the line shape antenna to a side of the electricity feeding portion is in the vicinity of the mouth of opening of the cut-off portion.

29. The high frequency wave glass antenna for an automobile according to any one of claim 1 through 24, wherein a cut-off portion having a smaller area than the area of a conducting portion of the grounding conductor is provided in the grounding conductor, and the total or a part of the electricity feeding portion is in the cut-off portion.

30. The high frequency wave glass antenna for an automobile according to any one of claim 24, wherein a cut-off portion is provided in the grounding conductor; the total or a part of the electricity feeding portion is in the cut-off portion, and the end of the line shape antenna to a side of the electricity feeding portion is in the vicinity of the mouth of opening of the cut-off portion.

31. The high frequency wave glass antenna for an automobile according to claim 24, wherein a received radiowave is 300 MHZ-3 GHz.

* * * * *